United States Patent [19]

Fleckenstein et al.

[11] 4,076,529

[45] Feb. 28, 1978

[54] PHOTOGRAPHIC DIFFUSION TRANSFER FILMS, PROCESSES AND COMPOSITIONS WITH COLOR MOIETY RELEASING COMPOUND

[75] Inventors: Lee J. Fleckenstein; John Figueras, both of Rochester, N.Y.

[73] Assignee: Eastman Kodak Company, Rochester, N.Y.

[21] Appl. No.: 351,673

[22] Filed: Apr. 16, 1973

Related U.S. Application Data

[63] Continuation-in-part of Ser. No. 282,796, Aug. 22, 1972, abandoned, which is a continuation-in-part of Ser. No. 176,751, Aug. 31, 1971, abandoned.

[51] Int. Cl.[2] ..... G03C 7/00; G03C 5/54; G03C 1/40; G03C 1/10

[52] U.S. Cl. ..... 96/3; 96/29 D; 96/56.6; 96/77; 96/99; 96/100 R

[58] Field of Search ..... 96/3, 29 D, 77, 99, 96/100, 56.6

[56] References Cited

U.S. PATENT DOCUMENTS

| | | | |
|---|---|---|---|
| 2,543,338 | 2/1951 | Schmidt et al. | 96/56.6 |
| 3,245,789 | 4/1966 | Rogers | 96/3 |
| 3,255,001 | 6/1966 | Blout et al. | 96/3 |
| 3,443,940 | 5/1969 | Bloom et al. | 96/3 |
| 3,734,726 | 5/1973 | Figueras et al. | 96/3 |
| 3,751,406 | 8/1973 | Bloom | 96/29 D |

*Primary Examiner*—Norman G. Torchin
*Assistant Examiner*—Richard L. Schilling
*Attorney, Agent, or Firm*—Robert W. Hampton

[57] ABSTRACT

Color photographic elements, compositions, diffusion transfer film units and processes are described which employ a nondiffusible p-sulfonamidoaniline or p-sulfonamidophenol which is preferably alkali-cleavable upon oxidation to release a diffusible color-providing moiety.

53 Claims, No Drawings

PHOTOGRAPHIC DIFFUSION TRANSFER FILMS, PROCESSES AND COMPOSITIONS WITH COLOR MOIETY RELEASING COMPOUND

This application is a continuation-in-part of our copending application Ser. No. 282,796 filed Aug. 22, 1972, now abandoned which in turn is a continuation-in-part of application Ser. No. 176,751 filed Aug. 31, 1971, now abandoned.

This invention relates to photography and more particularly to color photography employing dye image-providing materials comprising p-sulfonamidoanilines and p-sulfonamidophenols which are preferably alkali-cleavable upon oxidation to release a diffusible color-providing moiety.

Color, diffusion transfer processes of the prior art such as U.S. Pat. NO. 2,983,606 generally involve the use of a photographic element comprising a support coated with at least one silver halide emulsion layer having therein or contiguous thereto a dye developer. A liquid processing composition is applied to the photosensitive element and permeates the emulsion layer to dissolve the dye developer. As the exposed silver halide emulsion is developed, the oxidation product of the dye developer is immobilized or precipitated in situ with the developed silver, thereby providing an imagewise distribution of unoxidized dye developer dissolved in the liquid processing composition. This immobilization is apparently due, at least in part, to a change in the solubility characteristics of the dye developer upon oxidation, and particularly as regards its solubility in alkaline solutions. at least part of this imagewise distribution of unoxidized dye-developer is transferred to a superposed image-receiving layer to provide the transfer image.

In these prior art systems, the developer moiety of the dye developer is capable of developing any silver halide emulsion that it comes into contact with since it is a "reactive" species. For example, a cyan developer which is supposed to develop only the red-sensitive silver halide emulsion will develop the blue-sensitive or green-sensitive silver halide emulsion if development by the yellow and magenta dye developers, respectively, has not been completed by the time the cyan dye developer reaches these emulsions. Such unwanted development results in undesirable interimage effects. Accordingly, it is highly desirable to provide a transfer system in which the dye is not attached to a "reactive" moiety, such as a developer moiety, so that such dye can diffuse throughout the system without becoming immobilized in the "wrong" area. Thus, undesirable interimage effects are considerably reduced or eliminated to provide a transfer image with high color quality.

In U.S. Pat. Nos. 3,443,939; 3,443,940; and 3,443,941, "splittable" ring-closing compounds such a dye developers are described wherein a diffusible dye moiety is split off the compound and transferred to provide the desired image while the remainder of the compound undergoes an internal cyclization or ring closing reaction, usually as a result of reaction with an oxidized aromatic primary amino color developing agent. In U.S. Pat. Nos. 3,227,550; 3,227,551 and 3,227,552, nondiffusible couplers are described in certain embodiments which release preformed dyes as a result of a coupling reaction with oxidized color developing agent. Canadian Pat. No. 602,607 discloses p-phenylenediamine compounds which contain a dye moiety. These compounds can be oxidized to the quinonediamine and with subsequent treatment with strong alkali, deamination takes place releasing a diffusible dye for transfer to a reception layer. However, compounds are desired which provide improved dye-release mechanisms in photographic systems and which do not require the use of a color developing agent. In a particularly preferred embodiment of our invention, black-and-white developing agents are employed which provide certain advantages in speed of development, not causing dermatitis, etc.

It is therefore an object of this invention to provide photographic elements, film units, compositions and processes for producing photographic images in color in which only the dye portion of the dye image-providing material is transferred out of the photographic element by virtue of the improved dye release mechanism described herein.

It is another object of this invention to create in a photographic system a dye image by means of an alkali-cleavage mechanism after oxidation rather than by an intramolecular ring-closing mechanism.

It is still a further object of this invention to provide photographic systems for producing photographic transfer images in color in which the dye image-receiving layer can either be located on a separate support or can be located integrally with the photosensitive element.

These and other objects are achieved by our invention which is described hereinafter.

A photosensitive element according to our invention comprises a support having thereon at least one photosensitive silver halide emulsion layer, each silver halide emulsion layer having associated therewith a nondiffusible p-sulfonamidoaniline or p-sulfonamidophenol having a color-providing moiety attached through the sulfonamido group. In a highly preferred embodiment, the sulfonamido compound is alkali-cleavable upon oxidation to release a diffusible color-providing moiety from the benzene nucleus.

The above-described sulfonamido compounds may be represented by the following formula:

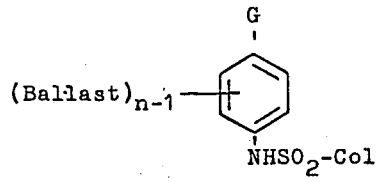

wherein

1. Col is a dye or dye precursor moiety;
2. Ballast is an organic ballasting radical of such molecular size and configuration (e.g., simple organic groups or polymeric groups) as to render the compound nondiffusible during development in an alkaline processing composition;
3. G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl propyl, butyl, secondary butyl, tert-butyl, cyclopropyl, 4-chlorobutyl, cyclobutyl, 4-nitroamyl, hexyl cyclohexyl, octyl, decyl, octadecyl, docosyl, benzyl, phenethyl, etc., (when $R_1$ is an alkyl group o greater than 6 carbon atoms, it can serve as a partial or sole Ballast group); and
4. *n* is a positive integer of 1 to 2 and is 2 when G i OR or when $R_1$ is hydrogen or an alkyl group of les than eight carbon atoms.

A preferred process for producing a photographic transfer image in color according to our invention comprises:

1. treating the above-described photosensitive element with an alkaline processing composition in the presence of a silver halide developing agent to effect development of each of the exposed silver halide emulsion layers, thereby oxidizing the developing agent;
2. the oxidized developing agent thereby cross-oxidizing the sulfonamido compound;
3. each cross-oxidized sulfonamido compound then cleaving, thus forming an imagewise distribution of diffusible dye or dye precursor as a function of the imagewise exposure of each of the silver halide emulsion layers; and
4. at least a portion of each of the imagewise distributions of diffusible dye or dye precursor diffusing to a dye image-receiving layer to provide an image.

It will be appreciated that there remains in the photographic element after transfer has taken place an imagewise distribution of dye or dye precursor in addition to developed silver. A color image comprising residual nondiffusible compound may be obtained in this element if the residual silver and silver halide are removed by any conventional manner well-known to those skilled in the photographic art, such as a bleach bath followed by a fix bath, a bleach-fix bath, etc. The imagewise distribution of dye or dye precursor may also diffuse out of the element into these baths, if desired, rather than to an image-receiving element. If a negative-working silver halide emulsion is employed in such photosensitive element, then a positive color image, such as a color transparency or motion-picture film, may be produced in this manner. If a direct-positive silver halide emulsion is employed in such photosensitive element, then a negative color image may be produced.

The photosensitive element in the above-described process can be treated with an alkaline processing composition to effect or initiate development in any manner. A preferred method for applying processing composition is by use of a rupturable container or pod which contains the composition. In general, the processing composition employed in our system contains the developing agent for development, although the composition could also just be an alkaline solution where the developer is incorporated in the photosensitive element, in which case the alkaline solution serves to activate the incorporated developer.

A photographic film unit according to our invention which is adapted to be processed by passing the unit between a pair of juxtaposed pressure-applying members, such as would be found in a camera designed for in-camera processing, comprises:

1. a photosensitive element as described above;
2. a dye image-receiving layer; and
3. means for discharging an alkaline processing composition within the film unit such as a rupturable container which is adapted to be positioned during processing of the film unit so that a compressive force applied to the container by the pressure-applying members will effect a discharge of the container's contents within the film unit;

the film unit containing a silver halide developing agent.

The dye image-receiving layer in the above-described film unit can be located on a separate support adapted to be superposed on the photosensitive element after exposure thereof. such image-receiving elements are generally disclosed, for example, in U.S. Pat. No. 3,362,819. a rupturable container is employed and is positioned in relation to the photosensitive element and the image-receiving element so that a compressive force applied to the container by pressure-applying members, such as would be found in a typical camera used for in-camera processing, will effect a discharge of the container's contents between the image-receiving element and the outermost layer of the photosensitive, element. After processing, the dye image-receiving element is separated from the photosensitive element.

The dye image-receiving layer in the above-described film unit can also be located integral with the photosensitive element between the support and the lowermost photosensitive silver halide emulsion layer. One useful format for integral receiver-negative photosensitive elements is disclosed in Belgian Pat. No. 757,960. In such an embodiment, the support for the phtosensitive element is transparent and is coated with an image-receiving layer, a substantially opaque light-reflective layer, e.g., $TiO_2$, and then the photosensitive layer or layers described above. After exposure of the photosensitive element, a rupturable container containing an alkaline processing composition and an opaque process sheet are brought into superposed position. Pressure-applying members in the camera rupture the container and spread processing composition over the photosensitive element as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photosensitive elements in which the present invention can be employed is disclosed in Belgian Pat. No. 757,959. In this embodiment, the support for the photosensitive element is transparent and is coated with the image-receiving layer, a substantially opaque, light-reflective layer and the photosensitive layer or layers described above. A rupturable container containing an alkaline processing composition and an opacifier is positioned adjacent to the top layer and a transparent top sheet. The film unit is placed in a camera, exposed through the transparent top sheet and then passed through a pair of pressure-applying members in the camera as it is being removed therefrom. The pressure-applying members rupture the container and spread processing composition and opacifieer over the negative portion of the film unit to render it light-insensitive. The processing composition develops each silver halide layer and dye images are formed as a result of development which diffuse to the image-receiving layer to provide a positive, right-reading image which is viewed through the transparent support on the opaque reflecting layer background. For further details concerning the format of this particular integral film unit, reference is made to the above-mentioned Belgian Pat. No. 757,959.

Still other useful integral formats in which our sulfonamido chemistry can be employed are described in U.S. Pat. Nos. 3,415,644; 3,415,645; 3,415,646; 3,647,437; and 3,635,707.

In the formula listed above for our compounds which are alkali-cleavable upon oxidation, R is preferably hydrogen, although it could be any hydrolyzable entity well-known to those skilled in the art, e.g., acetyl, mono-, di- or trichloroacetyl radicals, perfluoracyl, pyruvyl, alkoxyacyl, nitrobenzoyl, cyanobenzoyl, sulfonyl, sulfinyl, etc.

The nature of the ballast group in the formula for the compounds described above (Ballast) is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least eight carbon atoms such as a substituted or unsubstituted alkyl group of eight to 22 carbon atoms, an amide radical having eight to 30 carbon atoms, a keto radical having eight to 30 carbon atoms, etc., and may even comprise a polymer backbone or a dye or dye precurser (Col) as defined below, e.g.,

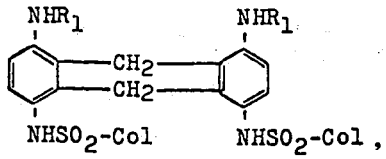

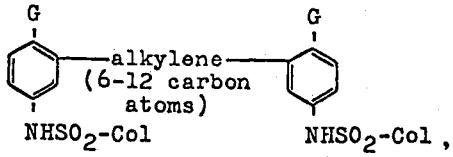

etc., wherein G, $R_1$ and Col have the same definitions as in the formula above.

In addition to Ballast, the benzene nucleus in the above formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic rings, a heterocyclic ring, etc. Preferably an aromatic ring is directly fused to the benzene nucleus which would form, for example, a naphthol. Such a p-sulfonamidonaphthol is considered to be a species of a p-sulfonamidophenol and thus included within the definition. The same is true for p-sulfonamidoanilines of the invention.

As previously mentioned, Col in the above formula represents a dye or dye precursor moiety. Such moieties are well-known to those skilled in the art and include dyes such as azo, azomethine, azopyrazolone, indoaniline, indophenol, anthraquinone, triarylmethane, alizarin, merocyanine, nitro, quinoline, cyanine, indogoide, phthalocyanine, metal complexed dyes, etc., and dye precursors such as a leuco dye, a group containing a reduced imine linkage which upon oxidation forms an imine dye chromophore as described and claimed in our coworkers' Lestina and Bush copending application Ser. No. 206,836 filed Dec. 10, 1971, and their continuation-in-part application Ser. No. 308,869 filed Nov. 22, 1972, a "shifted" dye which shifts hypsochromically or bathochromically when subjected to a different environment such as a change in pH, reaction with a material to form a complex, etc. Col could also be a coupler moiety such as a phenol, naphthol, indazolone, open-chain benzoyl acetanilide, pivalylacetanilide, malonamide, malonanilide, cyanoacetyl, coumarone, pyrazolone, compounds described in U.S. Pat. No. 2,756,142, etc. These compounds may contain a solubilizing group if desired. Examples of such dye groups include the following:

YELLOW DYE GROUPS

4-Hydroxy azobenzene

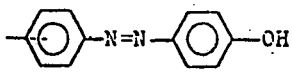

3-methyl-4-hydroxy azobenzene

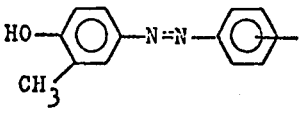

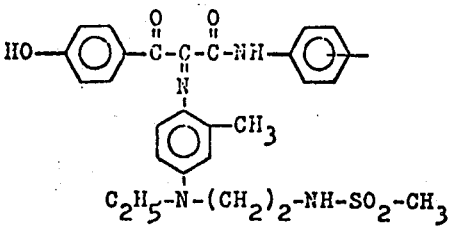

p-sulfhydryl azobonzene

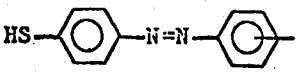

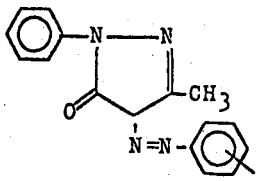

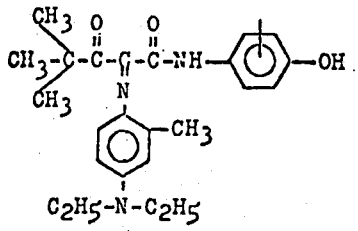

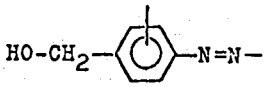

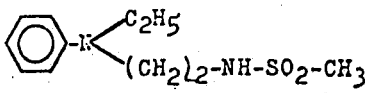

MAGENTA DYE GROUPS

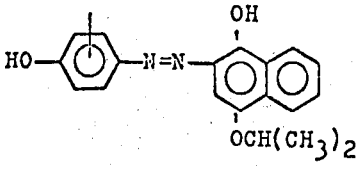

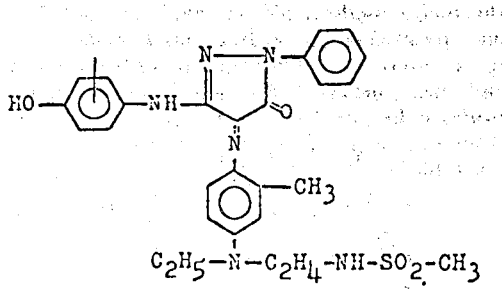

CYAN DYE GROUPS

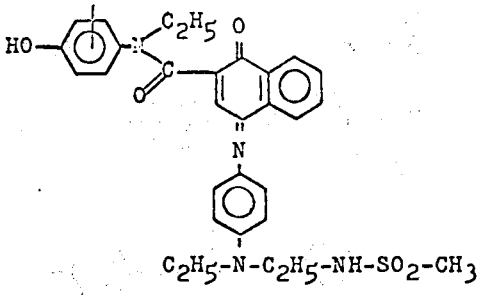

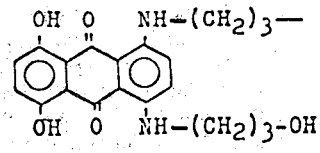

When dye precursor moieties are employed in our invention instead of dyes, they are converted to dyes by means well-known to those skilled in the art, e.g., oxidation, either in the photosensitive element, in the processing composition or in the dye image-receiving layer to form a visible dye. Such techniques are disclosed, for example, in British Patents 1,157,501; 1,157,5 1,157,503; 1,157,504; 1,157,505; 1,157,506; 1,157,507; 1,157,508; 1,157,509; 1,157,510 and U.S. Pats. 2,774,668; 2,698,798; 2,698,244; 2,661,293; 2,559,643; etc.

Compounds within the scope of our invention include the following:

Compound No. I 3-Pentadecyl-4-(p-phenylazobenzenesulfonamido)phenol

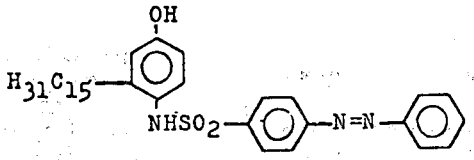

Compound No. II 1-Hydroxy-4-(p-phenylazobenzenesulfonamido)-2-[α-(2,4-di-tert-amylphenoxy)-n-butyl]-naphthamide

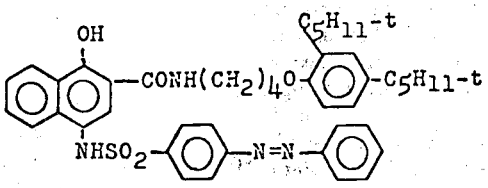

Compound No. III 8-Acetamido-3,6-disulfo-2-{p-[(4-hydroxy-2-pentadecyl)-phenylsulfamoyl]phenylazo}-1-naphthol monopyridinium salt

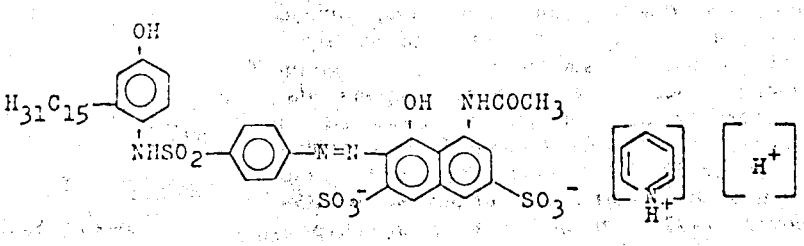

Compound No. IV 2-{p-[(4-Hydroxy-2-pentadecyl)-phenylsulfamoyl]-phenylazo}-4-isopropoxynaphthol

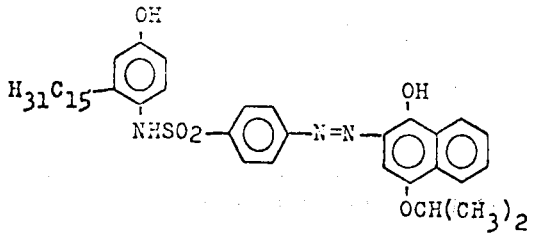

Compound No. V 4-{p-[4'-(N,N-Dimethylamino)-phenylazo]-benzenesulfonamido}-3-pentadecylphenol

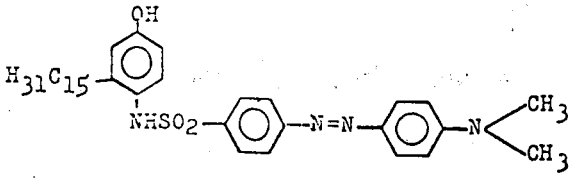

Compound No. VI 1-Hydroxy-4-[4-(1-hydroxy-4-isopropoxy-2-naphthylazo)-benzenesulfonamido]-2-[δ-(2,4-di-tert-amylphenoxy)-n-butyl]-naphthamide

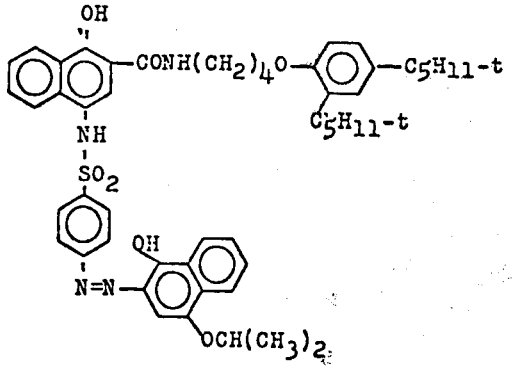

Compound No. VII 1-Hydroxy-4-[3-(1-phenyl-3-methylcarbamyl-4-pyrazolin-5-onylazo)-benzenesulfonamido]-2-[δ-(2,4-di-tert-amylphenoxy)-n-butyl]-naphthamide

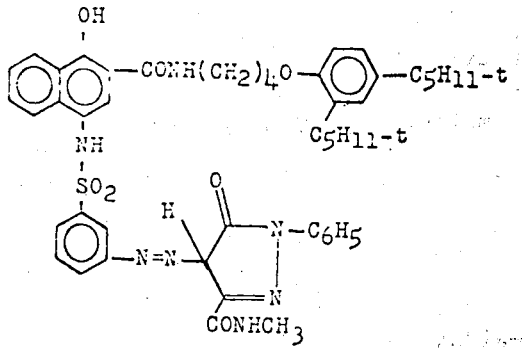

Compound No. VIII 4-[p-(4'-Dimethylaminophenylazo)-benzenesulfonamido]-N-n-dodecylaniline

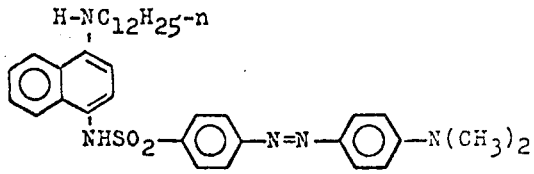

Compound No. IX 3-Pentadecyl-4-(p-phenylazobenzenesulfonamido)-aniline

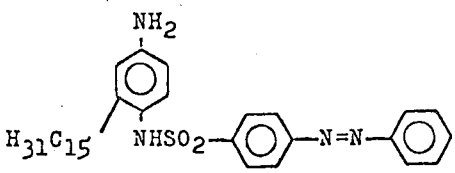

Compound No. X 1-(N-n-Dodecylamino)-4-(p-phenylazobenzenesulfonamido)-naphthalene

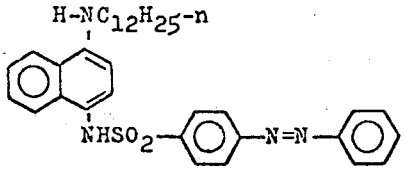

Compound No. XI 2-{p-[(4—amino— 2-pentadecyl)-benzenesulfamyl]-phenylazo}-4-isopropoxynaphthol

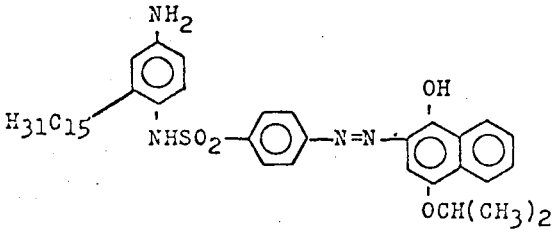

Compound No. XII 4-{p-[4'-(N',N'-dimethylamino)-phenylazo]-benzenesulfonamido}-3-octyl-N-ethylaniline

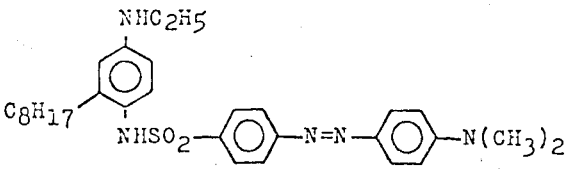

Compound No. XIII 5-{p-[4'-(N,N-Dimethylamino)-phenylazo]-benzenesulfonamido}-8-(N'-n-dodecylamino)-quinoline

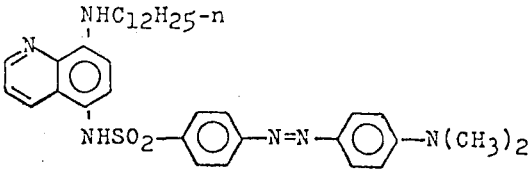

Compound No. XIV - Shifted Magenta Dye-Providing

1-Hydroxy-4-[3-(N-[4-(3,5-dibromo-4-hydroxyphenylimino)-1-phenyl 2-pyrazolin-5-on-3-yl]carbamyl)-benzenesulfonamido]-2-[α-(2,4-di tert-amylphenoxy)-n-butyl]naphthamide

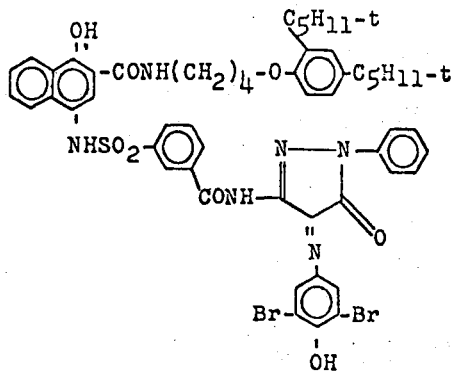

Compound No. XV - Cyan Dye-Providing (Initially Leuco)

1-Hydroxy-4-[3-(4-[3-chloro-5-(3,5-dichloro-4-hydroxyanilino)-2-hydroxy-4-methylanilino]-6-hydroxy-s-triazinyl-2-amino)-benzenesulfonamido]-2-[α-(2,4-di-tert-amylphenoxy)-n-butyl]-naphthamide

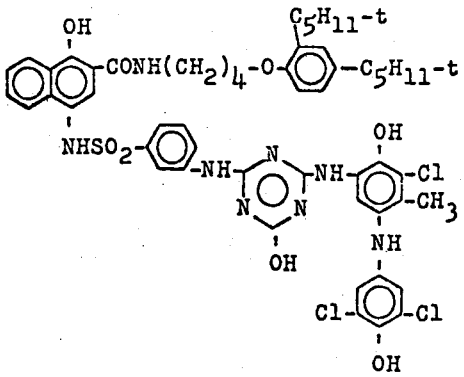

Compound No. XVI - Shifted Yellow Dye-Providing

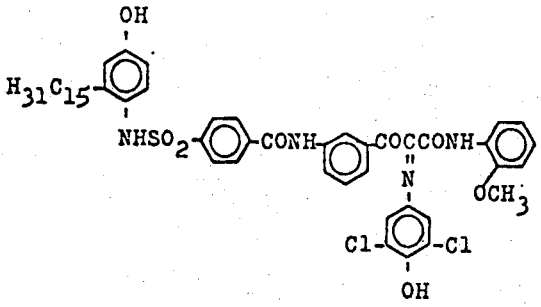

Compound No. XVII - Shifted Yellow Dye-Providing

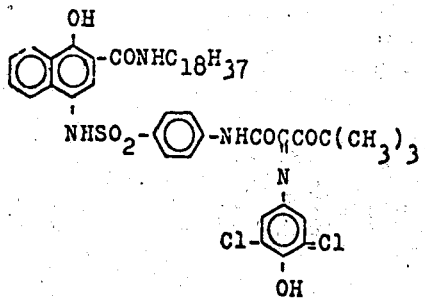

Compound No. XVIII - Shifted Magenta Dye-Providing
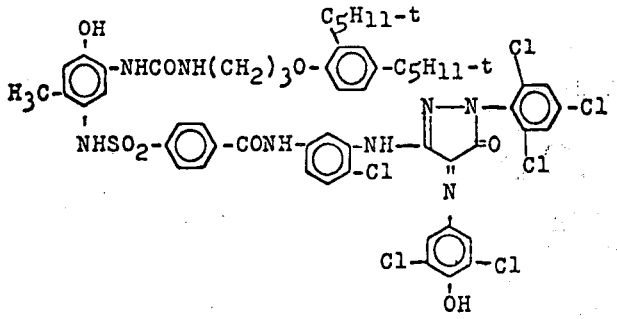
Compound No. XIX - Shifted Magenta Dye-Providing
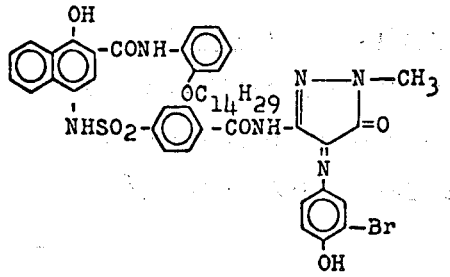
Compound No. XX - Shifted Cyan Dye-Providing
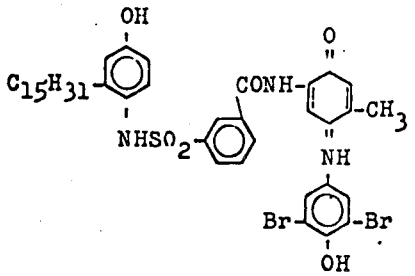
Compound No. XXI - Shifted Cyan Dye-Providing
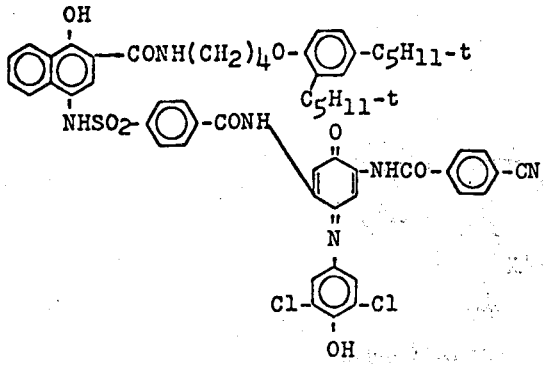
Compound No. XXII - Cyan Dye-Providing
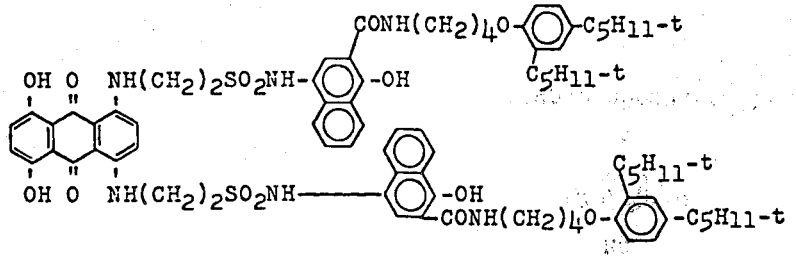

Compound No. XXIII -Shifted Yellow Dye-Providing
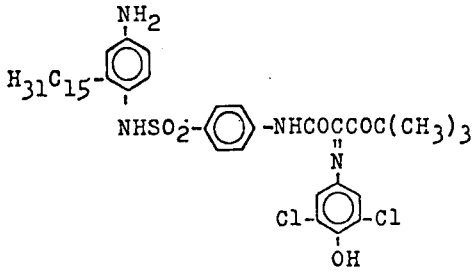
Compound No. XXIV - Shifted Yellow Dye-Providing
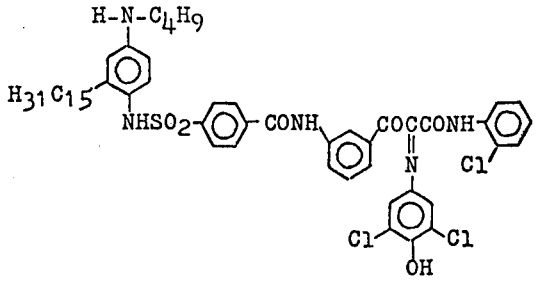
Compound No. XXV - Shifted Magenta Dye-Providing
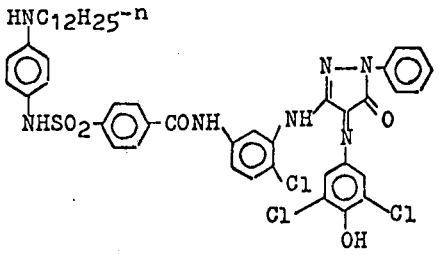
Compound No. XXVI - Shifted Magenta Dye-Providing
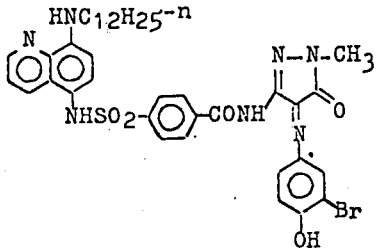
Compound No. XXVII - Shifted Cyan Dye-Providing
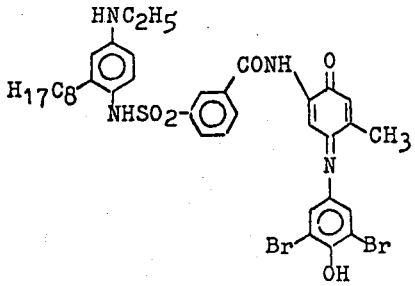

Compound No. XXVIII - Shifted Cyan Dye-Providing
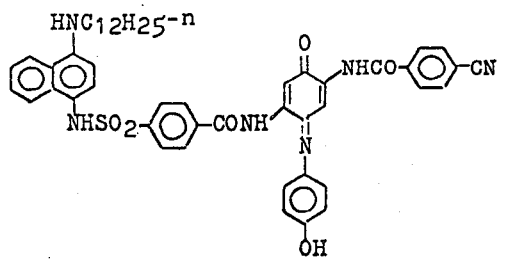
Compound No. XXIX - Yellow Dye-Providing (Initially Leuco)
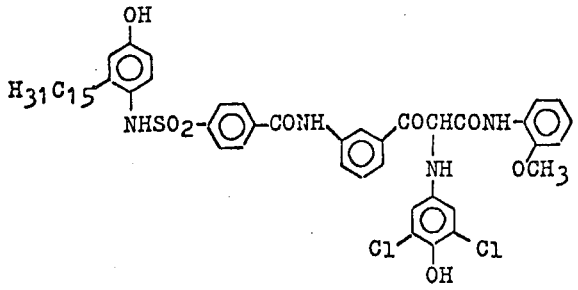
Compound No. XXX - Yellow Dye-Providing (Initially Leuco)
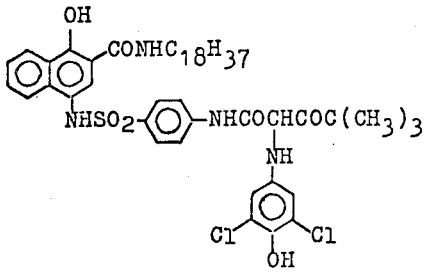
Compound No. XXXI - Magenta Dye-Providing (Initially Leuco)
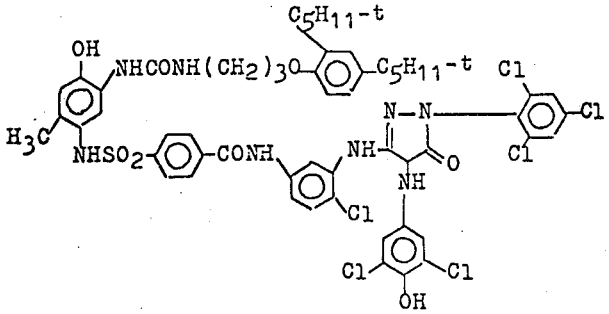
Compound No. XXXII - Magenta Dye-Providing (Initially Leuco)
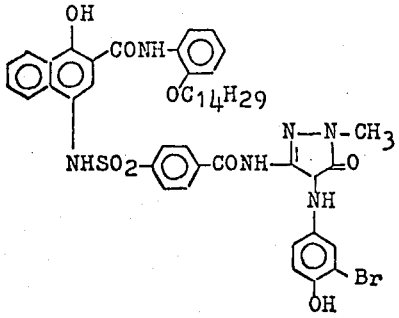

Compound No. XXXIII - Cyan Dye-Providing (Initially Leuco)
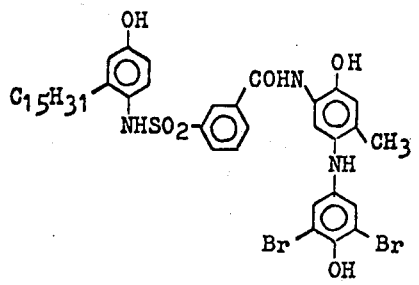
Compound No. XXXIV - Cyan Dye-Providing (Initially Leuco)
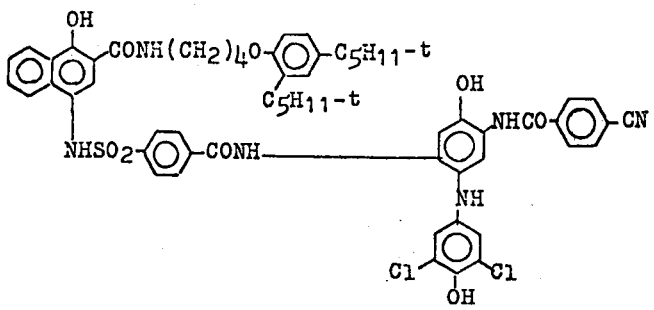
Compound No. XXXV - Yellow Dye-Providing (Initially Leuco)
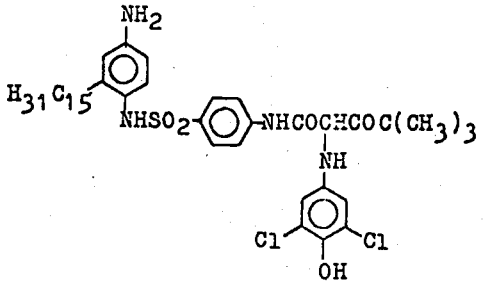
Compound No. XXXVI - Yellow Dye-Providing (Initially Leuco)
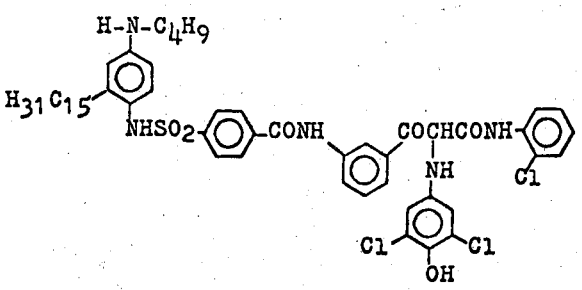
Compound No. XXXVII - Magenta Dye-Providing (Initially Leuco)
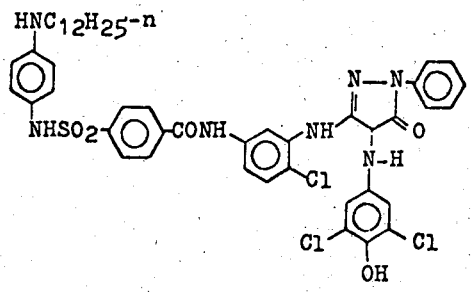

Compound No. XXXVIII - Magenta Dye-Providing (Initially Leuco)
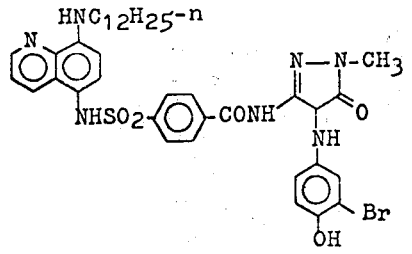
Compound No. XXXIX - Cyan Dye-Providing (Initially Leuco)
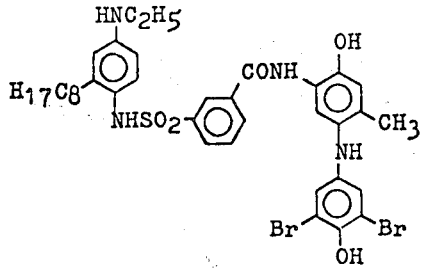
Compound No. XL - Cyan Dye-Providing (Initially Leuco)
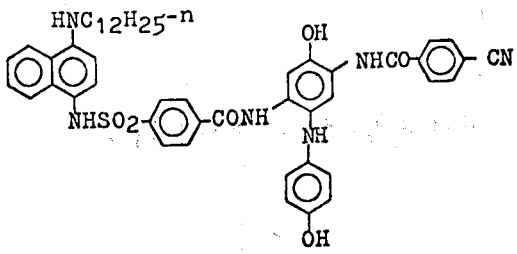
Compound XLI - Yellow Dye-Releasing
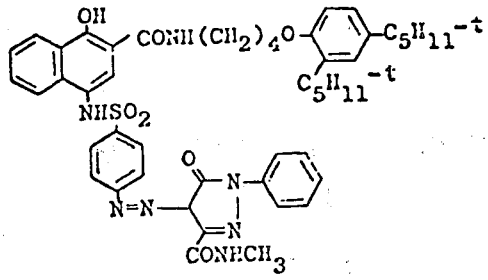
Compound XLII - Magenta Dye-Releasing
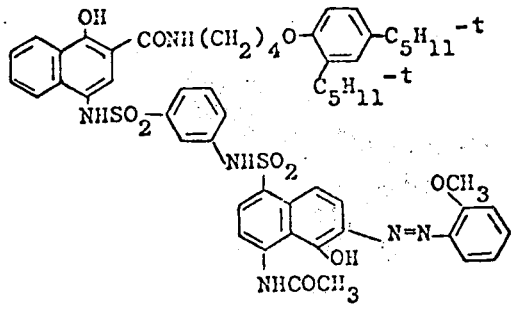

Compound XLIII - Magenta Dye-Releasing

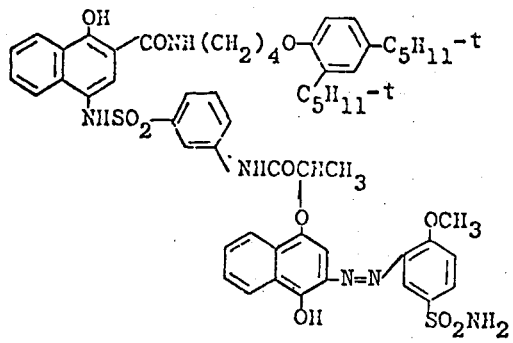

Compound XLIV - Magenta Dye-Releasing

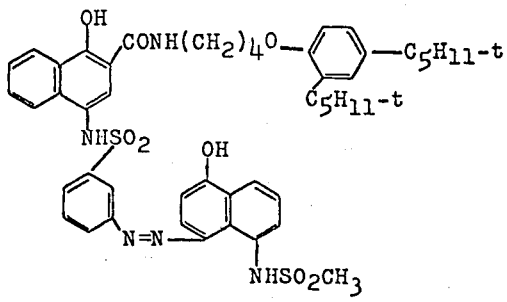

Compound XLV - Cyan Dye-Releasing

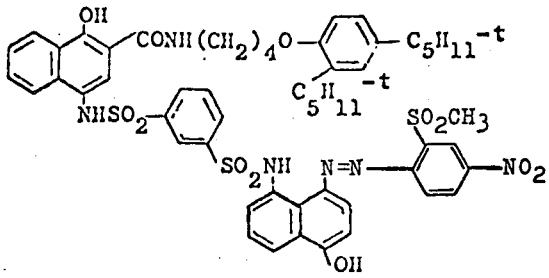

Of the above compounds, especially good results are obtained with Compound Nos. III, IV, V, VI, VII, VIII and XIV. Compounds XLII, XLIII, XLIV and XLV are the subject of separate inventions by our coworkers.

The film unit or assembly of the present invention may be used to produce positive images in single- or multicolors. In the three-color system, each silver halide emulsion layer of the film assembly will have associated therewith a dye imageproviding material possessing a predominant spectral absorption within the region of the visible spectrum to which said silver halide emulsion is sensitive, i.e., the blue-sensitive silver halide emulsion layer will a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous to the silver halide emulsion layer.

The concentration of the copounds which preferably are alkali-cleavable upon oxidation that are employed in the present invention may be varied over a wide range depending upon the particular compound employed and the results which are desired. For example, the dye image-providing compounds of the present invention may be coated in layers by using coating solutions containing between about 0.5 and about 8 percent by weight of the dye image-providing compound distributed in a hydrophilic film-forming natural material or synthetic polymer, such as gelatin, polyvinyl alcohol, etc., which is adapted to be permeated by aqueous alkaline processing composition.

Any silver halide developing agent can be employed in our invention as long as it cross-oxidizes with the dye imageproviding compounds described herein. The developer may be employed in the photosensitive element to be activated by the alkaline processing composition. Specific examples of developers which can be employed in our invention include:

hydroquinone
N-methylaminophenol
Phenidone (1-phenyl-3-pyrazolidone)
Dimezone (1-phenyl-4,4-dimethyl-3-pyrazolidone)
ascorbic acid
aminophenols
N-N-diethyl p-phenylenediamine
3-methyl-N,N-diethyl-p-phenylenediamine
3-methoxyl-N-ethyl-N-ethoxy-p-phenylenediamine, etc.

The black-and-white developers in this list are preferred, however, since they avoid any propensity of staining the dye imagereceiving layer.

In a preferred embodiment of our invention, as was mentioned previously, the silver halide developer in our process becomes oxidized upon development and reduces silver halide to silver metal. The oxidized developer then cross-oxidizes the dye-releasing compound. The product of cross-oxidation then undergoes alkaline hydrolysis, thus releasing an imagewise distribution of diffusible dye or dye precursor which then diffuses to the receiving layer to provide the positive dye image. The diffusible moiety is transferable in alkaline processing composition either by virtue of its self-diffusivity or by having attached to it one or more solubilizing groups such as COOH, $SO_3H$, $SO_2NHX$, OH, SH, etc. Although it is not intended to limit the present invention to any particular theory or reaction mechanism, it is believed that the following chemical reactions take place according to a particular preferred process of the invention:

1. Development of a latent image with hydroquinone, thereby oxidizing it to a quinone

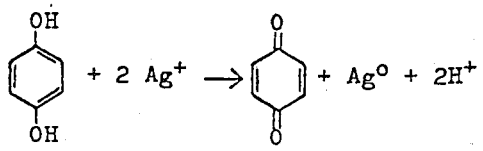

2. Cross-oxidation step in which quinone is reduced and dye-releasing compound is oxidized

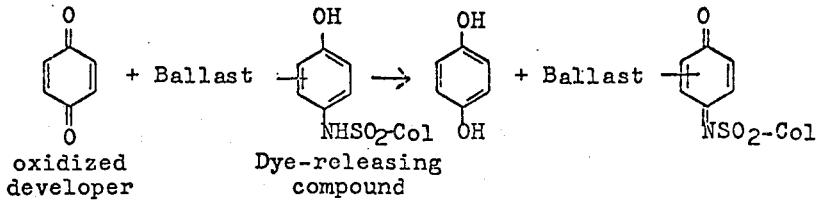

3. Alkaline hydrolysis to release a diffusible dye

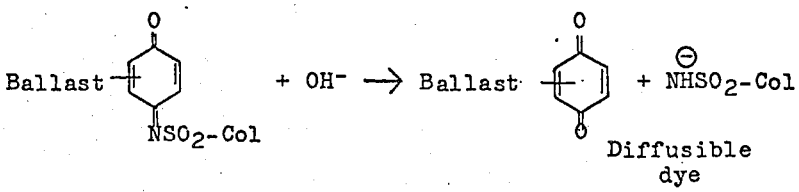

In using the dye-releasing compounds according to our invention, the production of diffusible dye or dye precursor images is a function of the reduction of developable silver halide images which may involve direct or reversal development of the silver halide emulsions with a silver halide developing agent. If the silver halide emulsion employed is a directpositive silver halide emulsion, such as an internal-image emulsion or a solarizing emulsion, which is developable in unexposed areas, a positive image can be obtained on the dye image-receiving layer. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction in a preferred embodiment of our invention, to release the preformed dyes or the dye precursors imagewise as a function of the imagewise exposure of each of the silver halide emulsion layers. At least a portion of the imagewise distributions of diffusible dyes or dye precursors diffuse to the image-receiving layer to form a positive image of the original subject. After being contacted by the alkaline processing composition, a pH-lowering layer in the film unit or image-receiving unit (if such a layer is needed) lowers the pH of the film unit or image receiver to stabilize the image.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al in U.S. Pat. No. 2,592,250 issued Apr. 8, 1952, and elsewhere in the literature. Internal-image silver halide emulsions can be defined in terms of the increased maximum density obtained when developed with "internal-type" developers over that obtained when developed with "surf-type" developers. Suitable internal-image emulsions are those which, when measured according to normal photographic techniques by coating a test portion of the silver halide emulsion on a transparent support, exposing to a light-intensity scale having a fixed time between 0.01 and 1 second, and developing for 3 minutes at 20°C. in developer A below ("internal-type"-developers have a maximum density at least five times the maximum density obtained when an equally exposed silver halide emulsion is developed for 4 minutes at 20°C. in Developer B described below ("surface-type" developer). Preferably, the maximum density in Developer A is at least 0.5 density unit greater than the maximum density in Developer B.

| DEVELOPER A | |
|---|---|
| Hydroquinone | 15 g. |
| Monomethyl-p-aminophenol sulfate | 15 g. |
| Sodium sulfite (desiccated) | 50 g. |
| Potassium bromide | 10 g. |
| Sodium hydroxide | 25 g. |
| Sodium thiosulfate | 20 g. |
| Water to make one liter. | |

| DEVELOPER B | |
|---|---|
| P-hydroxyphenylglycine | 10 g. |
| Sodium carbonate | 100 g. |
| Water to make one liter | |

The solarizing direct-positive silver halide emulsions useful in the above-described embodiment are well-known silver halide emulsions which have been effectively fogged either chemically or by radiation to a point which corresponds approximately to the maximum density of the reversal curve as shown by Mees, *The Theory of the Photographic Process*, published by the Macmillan Co., New York, New York, 1942, pages 261–297. Typical methods for the preparation of solarizing emulsions are shown by Groves British Pat. No. 443,245, Feb. 25, 1936, who subject emulsions to Roentgen rays "until an emulsion layer formed there from, when developed without preliminary exposure, is blackened up to the apex of its graduation curve"; Szaz British Pat. No. 462,730, Mar. 15, 1937, the use of either light or chemicals such as silver nitrate, organic sulfur compounds and dyes to convert ordinary silver halide emulsions to solarizing direct positive emulsions; and Arens U.S. Pat. No. 2,005,837, June 25, 1935, the use of silver nitrate and other compounds in conjunction with heat to effect solarization. Kendall and Hill U.S. Pat. No. 2,541,472, Feb. 13, 1951, shows useful solarized emulsions particularly susceptible to exposure with long wavelength light and initial development to produce the Herschel effect described by Mees above, produced by adding benzothiazoles and other compounds to the emulsions which are fogged either chemically or with white light. In using the emulsions a sufficient reversal image exposure is employed using minus blue light of from about 500–700 m$\mu$ wavelength preferably 520–554 m$\mu$, to substantially destroy the latent image in the silver halide grains in the region of the image exposure. Particularly useful are the fogged direct-positive emulsions of Berriman U.S. Pat. No. 3,367,778; Illingsworth U.S. Pat Nos. 3,501,305, 3,501,306 and 3,501,307; and combinations thereof.

Internal-image silver halide emulsions which contain or which are processed in the presence of fogging or nucleating agent are particularly useful in the above-described embodiment since the use of fogging agents is a convenient way to inject electrons into the silver halide grains. Suitable fogging agents include the hydrazines disclosed in Ives U.S. Pat. Nos. 2,588,982 issued Mar. 11, 1952 and 2,563,785 issued Aug. 7, 1951; the hydrazides and hydrazones disclosed in Whitmore U.S. Pat. No. 3,227,552 issued Jan 4, 1966; hydrazone quaternary salts described in Lincoln and Heseltine application Ser. No. 828,064 filed Apr. 28, 1969; or mixtures thereof. The quantity of fogging agent employed can be widely varied depending upon the results desired. Generally, the concentration of fogging agent is from about 1 to about 20 mg. per square foot of photosensitive layer in the photosensitive element or from about 0.1 to about 2 grams per liter of developer if it is located in the developer.

Other embodiments in which our imaging chemistry can be employed include the techniques described in U.S. Pat. Nos. 3,227,550, 3,227,551, 3,227,552 3,364,022, and in British Pat. No. 904,364, p. 19, lines 1–41, wherein our dye imageproviding materials are substituted for the nondiffusible dyeproviding couplers described therein. For example, a film unit using development inhibitor-releasing couplers as described in U.S. Pat. No. 3,227,551 may be employed in conjunction with the dye image-providing materials described herein. In this method, however, the developing agent employed must include one which oxidatively couples to release the inhibitor compounds. These developing agents are generally selected from the class of aromatic primary amino developing agents such as p-aminophenols or p-phenylenediamines.

Another embodiment of our invention uses the image-reversing technique disclosed in British Pat. No.904,364, page 19, lines 1–41. In this system our dye-releasing compounds are used in combination with physical development nuclei in a nuclei layer contiguous to the photosensitive silver halide emulsion layer. The film unit contains a silver halide solvent, preferably in a rupturable container with the alkaline processing composition, and the photosensitive element contains an immobilizing coupler, which is capable of reacting with oxidized developer to form an immobile product. This embodiment also must include developing agents which are reactive with the immobilizing coupler. Preferred compounds include the primary aromatic amines described above.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a Carey Lea silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The silver halide emulsions used in this invention can comprise, for example, silver chloride, silver bromide, silver chlorobromide, silver bromoiodide, silver chlorobromoiodide or mixtures thereof. The emulsions can be coarse- or fine-grain and can be prepared by any of the well-known procedures, e.g., single-jet emulsions such as those described in Trivelli and Smith, The Photographic Journal, Vol. LXXIX, May, 1939 (pp 330–338), double-jet emulsions, such as Lippmann emulsions, ammoniacal emulsions, thiocyanate or thioether ripened emulsions such as those described in Nietz et al U.S. Pat. No. 2,222,264 issued Nov. 19,1940; Illingsworth U.S. Pat. No. 3,320,069 issued May 16, 1967; and McBride U.S. Pat. No. 3,271,157 issued Sept. 6, 1966. Surface-image emulsions can be used or internal-image emulsions can be used such as those described in Davey et al. U.S. Pat. No. 2,592,250 issued May 8, 1952; Porter et al. U.S. Pat. No. 3,206,313 issued Sept. 14, 1965; Berriman U.S. Pat. No. 3,367,778 issued Feb. 6, 1968; and Bacon et al. U.S. Pat. No. 3,447,927 issued June 3, 1969. The emulsions may be regular-grain emulsions such as the type described in Klein and Moisar, *J. Phot. Sci.*, Vol. 12, No. 5, Sept./Oct., 1964, (pp. 242–251). Negative-type emulsions may be used or direct-positive emulsions may be used such as those described in Leermakers U.S. Pat. No. 2,184,013 issued Dec. 19, 1939; Kendall et al. U.S. Pat. No. 2,541,472 issued Feb. 13, 1951; Berriman U.S. Pat. No. 3,367,778 issued Feb. 6, 1968; Schouwenaars British Pat. No. 723,019 issued Feb. 2, 1955; Illingsworth et al. French Pat. No. 1,520,821 issued Mar. 4, 1968; Illingsworth U.S. Pat. 3,501,307 issued Mar. 17, 1970; Ives U.S. Pat. No. 2,563,785 issued Aug. 7, 1951; Knott et al. U.S. Pat. No. 2,456,953 issued Dec. 21, 1948; and Land U.S. Pat. No 2,861,885 issued Nov. 25, 1958.

The rupturable container employed in this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color film unit according to this invention, each silver halide emulsion layer containing a dye image-providing material or having the dye image-providing material present in a contiguous layer may be separated from the other silver halide emission layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104; 3,043,692; 3,044,873; 3,061,428; 3,069,263; 3,069,264; 3,121,011; and 3,427,158.

Generally speaking, except where noted otherwise, the silver halide emulsion layers in the invention comprise photosensitive silver halide dispersed in gelatin and are about 0.6 to 6 microns in thickness; the dye image-providing materials are dispersed in an aqueous alkaline solution-permeable polymeric binder, such as a gelatin, as a separate layer about 1 to 7 microns in thickness; and the alkaline solution-permeable polymeric interlayers, e.g., gelatin, are about 1 to 5 microns in thickness. Of course these thicknesses are approximate only and can be modified according to the product desired.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described in Minsk U.S. Pat. No. 2,882,156 issued Apr. 14, 1959, and basic polymeric mordants such as described in copending U.S. Application Ser. No. 100,491 of Cohen et al. filed Dec. 21, 1970. Other mordants useful in our invention include poly-4-vinylpyridine, the 2-vinyl pyridine polymer metho-p-toluene sulfonate and similar compounds described in Sprague et al. U.S. Pat. No. 2,484,430 issued Oct. 11, 1949, and cetyl trimethylammonium bromide, etc. Effective mordanting compositions are also described in Whitmore U.S. Pat. No. 3,271,148 and Bush U.S. Pat. No. 3,271,147, both issued Sept. 6, 1966.

Furthermore, the image-receiving layer can be sufficient by itself to mordant the dye as in the case of use of an alkaline solution-permeable polymeric layer such as N-methoxymethyl polyhexylmethylene adipamide; partially hydrolyzed polyvinyl acetate; polyvinyl alcohol with or without plasticizers; cellulose acetate; gelatin; and other materials of a similar nature. Generally, good results are obtained when the image-receiving layer, preferably alkaline solution-permeable, is transparent and about 0.25 to about 0.40 mil in thickness. This thickness, of course, can be modified depending upon the result desired. The image-receiving layer can also contain ultraviolet absorbing materials to protect the mordanted dye images from fading due to ultraviolet light, brightening agents such as the stilbenes, coumarins, triazines, oxazoles, dye stabilizers such as the chromanols, alkylphenols, etc.

Use of pH-lowering material in the dye image-receiving element of a film unit according to the invention will usually increase the stability of the transferred image. Generally, the pH-lowering material will effect a reduction in the pH of the image layer from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such pH-lowering materials reduce the pH of the film unit after development to terminate development and substantially reduce further dye transfer and thus stabilize the dye image.

An inert timing or spacer layer can be employed in the practice of our invention over the pH-lowering layer which "times" or controls the pH reduction as a function of the rate at which alkali diffuses through the inert spacer layer. Examples of such timing layers include gelatin, polyvinyl alcohol or any of those disclosed in U.S. Pat. No. 3,455,686. The timing layer may be effective in evening out the various reaction rates over a wide range of temperatures, e.g., premature pH reduction is prevented when imbibition is effected at temperatures above room temperature, for example, at 95° to 100°F. The timing layer is usually about 0.1 to about 0.7 mil in thickness. Especially good results are obtained when the timing layer comprises a hydrolyzable polymer or a mixture of such polymers which are slowly hydrolyzed by the processing composition. Examples of such hydrolyzable polymers include polyvinyl acetate, polyamides, cellulose esters, etc.

The alkaline processing composition employed in this invention is the conventional aqueous solution of an alkaline material, e.g., sodium hydroxide, sodium carbonate or an amine such as diethylamine, preferably possessing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts or carboxymethyl cellulose such as sodium carboxymethyl cellulose. A concentration of viscosity-increasing compound of about 1 to about 5% by weight of the processing composition is preferred which will impart thereto a viscosity of about 100 cps. to about 200,000 cps. In certain embodiments of our invention, an opacifying agent, e.g., $TiO_2$, carbon black, etc., may be added to the processing composition.

While the alkaline processing composition used in this invention can be employed in a rupturable container, as described previously, to conveniently facilitate the introduction of processing composition into the film unit, other methods of inserting processing composition into the film unit could also be employed, e.g., interjecting processing solution with communicating members similar to hypodermic syringes which are attached either to a camera or camera cartridge.

The alkaline solution-permeable, substantially opaque, light-reflective layer employed in certain embodiments of photographic film units of our invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zince oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix such as, for example, gelatin, polyvinyl alcohol, and the like. Brightening agents such as the stilbenes, coumarins, triazines and oxazoles can also be added to the light reflective layer, if desired. When it is desired to increase the opacifying capacity of the light-reflective layer, dark-colored opacifying agents, e.g., carbon black, nigrosine dyes, etc., may be added to it, or coated in a separate layer adjacent to the light-reflective layer.

The supports for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-α-olefins such as polyethylene and polypropylene film, and related films or resinous materials. The support is usually about 2 to 6 mils in thickness.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in our invention are well-known to those skilled in the art and are described in *Product Licensing Index*, Vol. 92, December, 1971, publication 9232, p. 107, paragraph I, "Emulsion types"; they may be chemically and spectrally sensitized as described on p. 107, paragraph III, "Chemical sensitization," and pp. 108–109, paragraph XV, "Spectral sensitization," of the above article; they can be protected againt the production of fog and can be stabilized against loss of sensitivity during keeping by employing the materials described on p. 107, paragraph V, "Antifoggants and stabilizers," of the above article; they can contain development modifiers, hardeners, and coating aids as described on pp. 107–108, paragraph IV, "Development modifiers"; paragraph VII, "Hardeners"; and paragraph XII, "Coating aids," of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition," of the above article; and they can be coated by using the various techniques described on p. 109, paragraph XVIII, "Coating procedures," of the above article, the disclosures of which are hereby incorporated by reference.

The following examples further illustrate the invention.

EXAMPLE 1

Preparation of Compound No. I

To a solution of 16 g. of 4-amino-3-pentadecylphenol in 100 ml. pyridine cooled in an ice bath is added 14 g. of p-phenylazobenzenesulfonyl chloride. After 5 hours stirring, the mixture is poured into ice water containing 150 ml. concentrated hydrochloric acid. The resulting solid is recrystallized from ethanol, methanol, and acetonitrile to give an orange solid, m.p. 125°–127°C, resolidified, second m.p. 143°–144°C.

EXAMPLE 2

Preparation of Compound No. II

To a solution of 24.5 g of 4-amino-2-(N-[4′-(2,4-dit-ert-pentylphenoxy)-butyl]-carbamyl)-naphthol in 150 ml. pyridine cooled in an ice bath is added 15.5 g of p-phenylazobenzenesulfonyl chloride. After 2 hours stirring, the mixture is poured into ice water containing 150 ml concentrated hydrochloric acid. The resulting solid is recrystallized from ethyl acetate and from 1:1 tetrahydrofuran-ethanol to give an orange solid, m.p. 235°–237°C.

EXAMPLE 3

Preparation of Compound No. III

To a suspension of 2.4 g of 4-(p-aminobenzenesulfonamido)-3-pentadecylphenol in a mixture of 75 ml of glacial acetic acid and 6 ml concentrated hydrochloric acid is added a solution of 0.4 g sodium nitrate in 5 ml $H_2O$. The yellow suspension is stirred for one hour, then poured into a solution of 2.4 g acetyl H-acid in 100 ml methanol cooled in an ice bath. 50 Ml of pyridine is then added and the magenta-colored solution is stirred for 1 hour at 0°C, filtered, and concentrated to dryness under vacuum. The residual is washed with water and acetronitrile and recrystallized from ethanol to give a red solid.

EXAMPLE 4

Preparation of Compound No. IV

To a stirred suspension of 8.5 g of 4-(p-aminobenzenesulfonamido)-3-pentadecylphenol in 240 ml of glacial acetic acid is added 22 ml concentrated hydrochloric acid, followed by a solution of 1.5 g sodium nitrite in 10 ml water. The mixture is stirred at room temperature for 1 hour, then poured into a solution of 36 g potassium acetate and 4 g 4-isopropoxy-1-naphthol in 400 ml methanol cooled in an ice bath. The mixture is stirred for 1 hour at 0°C, filtered, and then concentrated to dryness under vacuum. The residue was recrystallized from methanol and isopropyl alcohol to yield a red solid, m.p. 83°–87°C.

EXAMPLE 5

Preparation of Compound No. V

To a stirred suspension of 7.6 g of 4-(p-aminobenzenesulfonamido)-3-pentadecylphenol in 200 ml of glacial acetic acid is added 20 ml concentrated hydrochloric acid, followed by a solution of 1.3 g sodium nitrite in 10 ml water. The mixture is stirred at room temperature for 50 minutes, then poured into a solution of 32 g potassium acetate and 6.1 g N,N-dimethylaniline in 350 ml methanol cooled in an ice bath. The mixture is stirred for 1 hour at 0°C and filtered. The collected solid is washed with methanol and water, then recrystallized from ethanol, cyclohexane-ethyl acetate, and isopropyl alcohol to give copper-orange plates, m.p. 141°–157°C.

EXAMPLE 6

A single layer supported gelatinous silver halide (cubic bromide) emulsion coating is prepared which contains per square foot of coating 60 mg of Compound No. I, 120 mg of di-n-butylphthalate, 100 mg of silver and 450 mg of gelatin. A sample of the photosensitive element is exposed to a graduated-density multicolor test object. A processing composition comprising Phenidone developing agent (1-phenyl-3-pyrozolidone) (0.5 g/1), NaOH (0.1 normal), and hydroxyethylcellulose (30 g/l) is employed in a pod and is spread between the exposed surface of the photosensitive element and a superposed dye image-receiving element comprising a support coated with 700 mg/ft$^2$ of gelatin and 150 mg/ft$^2$ of the mordant N-n-octadecyl-tributylammonium bromide, by passing the transfer "sandwich" between a pair of juxtaposed pressure rollers.

After 5 minutes at about 24°C, the film unit is separated. A negative yellow dye image is observed on the dye image-receiving sheet.

EXAMPLE 7

Example 6 is repeated except that the coating contains per square foot of coating 73 mg of Compound No. II, and 730 mg of tri-cresylphosphate. A negative yellow dye image is again obtained on the dye image-receiving sheet.

EXAMPLE 8

The procedure of Example 6 is repeated with a sample of a coating containing 100 mg of Compound No. III per square foot of coating. Compound No. III is incorporated into the emulsion by dissolving a measured quantity of Compound No. III in an ethanol/water mixture and adding the so obtained solution to the emulsion prior to coating. The processing composition employed comprises Phenidone developing agent (0.5 g/l), NaOH (1.0 normal), $Na_2SO_3$ (1 mole) and hydroxyethycellulose (30 g/l. After about 45 seconds at 24°C, a negative red-magenta image is obtained on the receiving sheet.

EXAMPLE 9

The procedure of Example 6 is repeated with a sample of a coating containing per square foot of coating 70 mg of Compound No. IV and 30 mg of di-n-butylphthalate. After 90 seconds at about 24°C, a negative red-magenta image is obtained on the dye image-receiving sheet.

A separate unexposed sample of this coating is treated for five minutes in Kodak F–5 Fix, rinsed with water, dried, emersed in the processing composition described in Example 6, and brought into contact for two minutes with a sample of the dye image-receiving element described above. No dye is transferred.

This example indicates that in order for our compounds to provide a diffusible dye image, the parent phenolic molecule must first be oxidized before release of the dye or dye precursor.

EXAMPLE 10

The procedure described in Example 6 is repeated with a coating containing per square foot of coating 61 mg of Compound No. V and 122 mg of di-n-butylphthalate. After about 90 seconds at about 24°C, a negative yellow image is obtained on the dye image-receiving sheet.

When an unexposed, fixed strip of this coating is treated with the processing solution and contacted with the receiving sheet for two minutes, no dye is transferred.

This example again indicates the resistance of our compounds to provide a diffusible dye image in their reduced, uncleaved state.

EXAMPLE 11

A photosensitive element is prepared by coating on an opaque cellulose acetate film support a negative-working gelatinsilver chlorobromide emulsion (300 mg gelatin/ft$^2$ and 74 mg silver/ft.$^2$) and magenta Compound No. VI (100 mg./ft.$^2$).

A dye image-receiving element is prepared by coating a N-n-hexadecyl-N-morpholinium ethosulfate/-methyl-tri-n-dodecylammonium p-toluenesulfonate coacervate mordant dispersion of the type described in U.S. Pat. no. 3,271,147 of Bush issued Sept. 6, 1966, on an opaque support.

A sample of the photosensitive element is exposed to a graduated-density multicolor test object. The following processing composition is employed in a pod and is spread between the exposed surface of the photosensitive element and the superposed dye image-receiving element by passing the transfer "sandwich" between a pair of juxtaposed pressure rollers:

| | |
|---|---|
| Sodium hydroxide | 20 g |
| Hydroxyethylcellulose | 25 g |
| 4-Methyl-4-hydroxymethyl- 1-phenyl-3-pyrazolidone | 0.75 g |
| Water to | 1000 ml |

After 60 seconds at about 25°C, the dye image-receiving element is separated from the "negative" element. A negative, magenta dye image is observed on the dye image-receiving element.

EXAMPLE 12

The procedure of Example 11 is repeated except that the processing composition does not contain any electron transfer agent 4-methyl-4-hydroxymethyl-1-phenyl-3-pyrazolidone. No visible dye image in the receiving element is obtained and no visible silver development takes place in the "negative" element. This example illustrates that the compounds of our invention are incapable of development themselves and require a separate silver halide developing agent in the system.

EXAMPLE 13

A photosensitive element is prepared by coating on an opaque cellulose acetate film support a negative-working gelatinsilver chlorobromide emulsion (300 mg gelatin/ft$^2$ and 97 mg silver/ft.$^2$). and yellow Compound No. VII (124 mg./ft.$^2$).

This element is exposed and processed as in Example 11 to obtain a negative, yellow dye image on the dye image-receiving element.

EXAMPLE 14

The procedure of Example 13 is repeated except that the processing composition does not contain any electron transfer agent 4-methyl-4-hydroxymethyl-1-phenyl-3-pyrazolidone. No visible dye image in the receiving element is obtained and no visible silver development takes place in the "negative" element. This example illustrates that the compounds of our invention are incapable of development themselves and require a separate silver halide developing agent in the system.

EXAMPLE 15

A multilayer, multicolor photosensitive element is prepared by coating the following layers in the order recited on an opaque cellulose acetate film support:

a. Red-sensitive, negative-working, gelatin-silver chlorobromide emulsion (300 mg gelatin/ft$^2$ and 97 mg silver/ft$^2$) and yellow Compound No. VII (124 mg./ft.$^2$),
b. An interlayer of gelatin (80 mg/ft$^2$), Phenidone (10 mg/ft$^2$) (incorporated developing agent), 2,5-di-tert-octylhydroquinone (20 mg/ft$^2$) (oxidized color developer scavenger) and yellow filter dye 1-(2,4,6-trichlorophenyl)-3- 3-[α-(2,4-di-tert-amylphenoxy)-acetamido]-benzamido -4-(4-methoxyphenylazo)-5-pyrazolone (75 mg/ft$^2$), and
c. Blue-sensitive, negative-working, gelatin-silver chlorobromide emulsion (300 mg gelatin/ft$^2$ and 74 mg silver/ft $^2$) and magenta Compound No. VI (100 mg./ft.$^2$).

A sample of the photosensitive element is exposed to a graduated density, multicolor test object. The following processing composition is employed in a pod and is spread between the exposed surface of the photosensitive element and a superposed dye image-receiving element similar to that of Example 11 by passing the transfer "sandwich" between a pair of juxtaposed pressure rollers:

| | |
|---|---|
| Sodium hydroxide | 40 g |
| Hydroxyethylcellulose | 25 g |
| Potassium bromide | 10 g |
| Water to | 1 liter |

(no developing agent is necessary in the processing composition since it is incorporated in the photosensitive element). After 60 seconds at about 25°C, the dye image-receiving element is separated from the "negative" element. A well-defined, negative, two-color magenta-yellow reproduction of the test object is observed on the dye image-receiving element.

EXAMPLES 16 – 33

Example 11 is repeated with the following alkali-cleavable compounds employed instead of Compound No. VI:

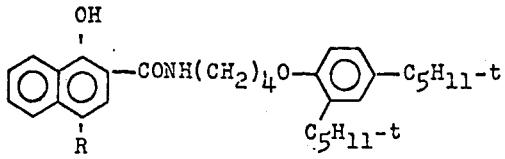

| Example | R | λ max of Image Dye In Receiving Element (nm) |
|---|---|---|
| 16 | 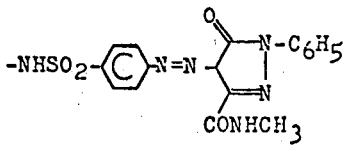 | 450 (yellow) |
| 17 | 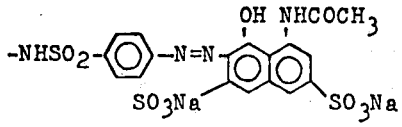 | 510 (magenta) |
| 18 | 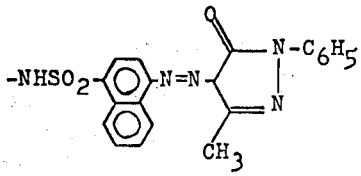 | 478 (yellow) |
| 19 | 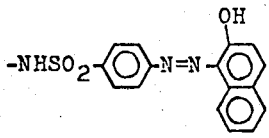 | 475 (yellow) |
| 20 | 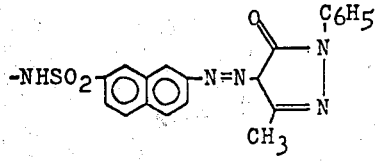 | 450 (yellow) |

Continued—
| Example | R | λmax of Image Dye in Receiving Element (nm.) |
|---|---|---|
| 21 | 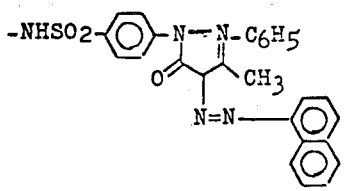 | 440 (yellow) |
| 22 | 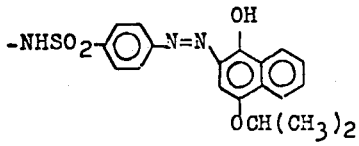 | 510 (magenta) |
| 23 | 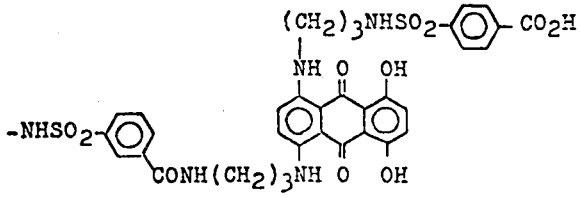 | (cyan) |
| 24 | 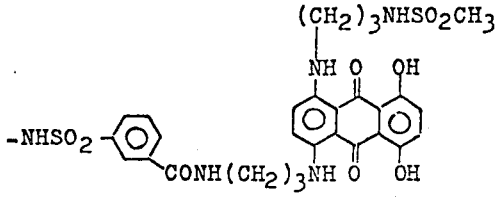 | (cyan) |
and the compounds having the following structure:
| | Structure | |
|---|---|---|
| 25 | 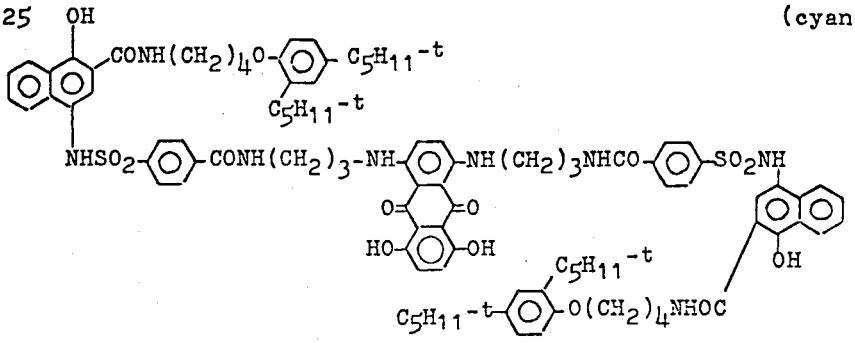 | (cyan) |
| 26 | 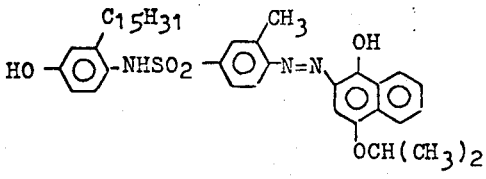 | 520 (magenta) |
| 27 | 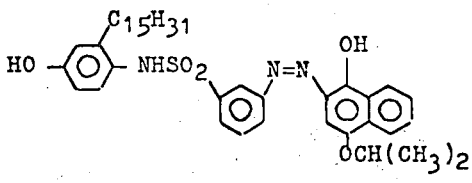 | 510 (magenta) |

Continued—
| Example | Structure | λmax of Image Dye in Receiving Element (nm.) |
|---|---|---|
| 28 | 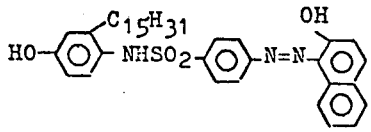 | 475 (yellow) |
| 29 | 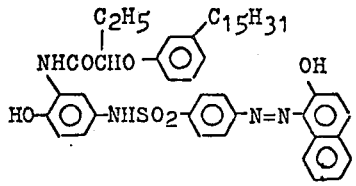 | 475 (yellow) |
| 30 | 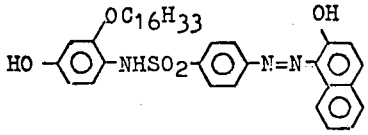 | 475 (yellow) |
| 31 | 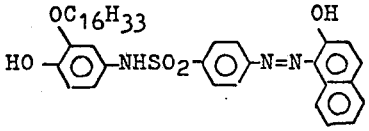 | 475 (yellow) |
| 32 | 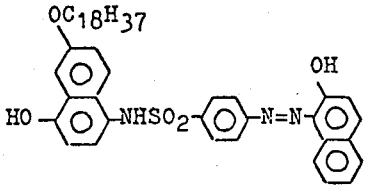 | 475 (yellow) |
| 33 | 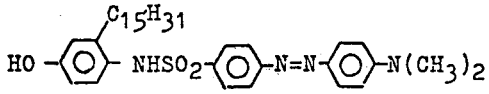 | 425 (yellow) |
EXAMPLE 34
Preparation of Compound No. VIII
Compound VIII is prepared as outlined in the following scheme:
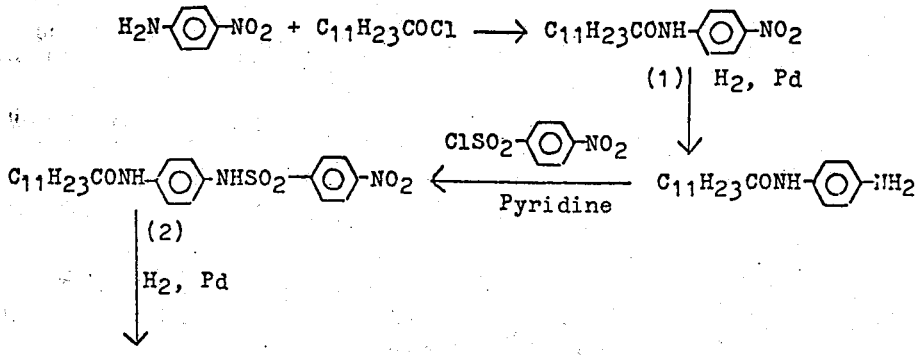

Continued—

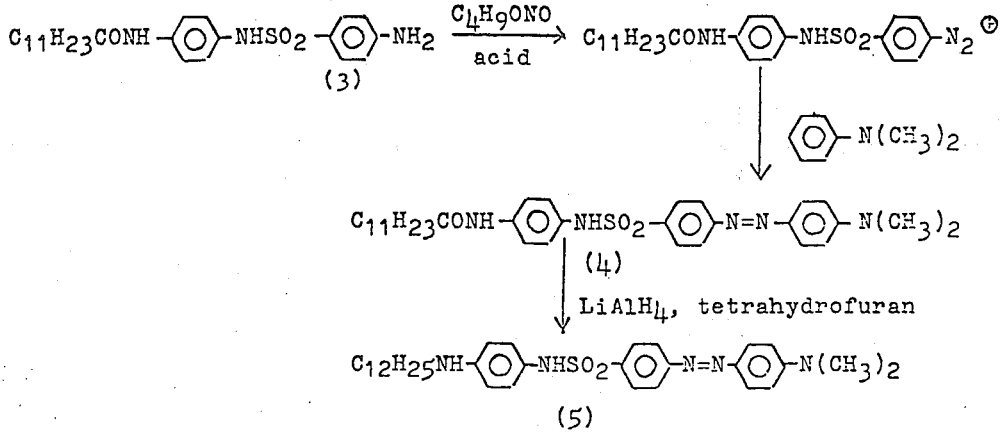

Procedures are as follows:

a. 4-nitrolauranilide (1) — Lauroyl chloride (109 g., 0.50 mole) is added portionwise over a 5-minute period to a mixture of 69 g. (0.50 mole) of 4-nitroaniline and 61 g. (0.50 mole) of N,N-dimethylaniline in 250 ml. of tetrahydrofuran solvent. The mixture is allowed to stand at ambient temperature for 1 hour. It is poured into 2.5 liters of water containing 10 ml. of concentrated hydrochloric acid. The solid which precipitates is filtered off, pressed dry and recrystallized from 750 ml. of acetonitrile. The yield of product is 154 g., m.p. 80° 81° C.

b. 4-(4-nitrobenzenesulfonamido) lauranilide (2) — The nitrolauranilide (1) (32.0 g., 0.10 mole) in 150 ml. of tetrahydrofuran solvent is reduced at 3 atm. hydrogen pressure over a pd-C catalyst. The catalyst is filtered off and the solvent stripped from the filtrate in vacuo. The crude amine is dried by adding 50 ml. of ethyl acetate and removing the ethyl acetate in vacuo. The white product is taken up in 150 ml. of pyridine and 22.2 g. (0.10 mole) of 4-nitrobenzenesulfonyl chloride is added. The pyridine solution is heated at the boiling point for 20 minutes, during which time the deep red solution becomes straw-colored. The solution is poured into 1 liter of water. The tan solid filtered, pressed dry and recrystallized from 800 ml. of acetonitrile. The yield is 43.0 g., m.p. 184–5° C.

c. 4-(4-aminobenzenesulfonamido) lauranilide (3)— The nitro compound (2) (86.8 g., 1.82 moles) is hydrogenated over Pd-C at 3 atm. pressure, using 250 ml. of tetrahydrofuran as solvent for each run. Reduction is done at 40–45° C. The theoretical amount of hydrogen is consumed in 1 hour. The batch is filtered and solvent removed in vacuo. The product is recrystallized from 400 ml. of acetonitrile to give 75.1 g. of amine, m.p. 151–53° C.

d. Diazotization of amine (3) and coupling to 4-(4-dimethylaminophenylazo)benzenesulfonamidolauranilide (4) - The amine (3) (4.45 g., 0.01 mole) is suspended in 40 ml. of dioxane and 10 cc. of tetrahydrofuran. Concentrated sulfuric acid (2.2 ml., 0.04 mole) is added with cooling to keep the temperature at 20° C. The solution is cooled to 5° C. and 1.20 cc. (0.01+ mole) of butyl nitrite is added with good stirring over a 5-minute period. The reaction mixture is allowed to stand at 5° – 10° C. for 20 minutes. It is poured into a chilled solution of 1.30 ml. (0.01+ mole) of N,N-dimethylaniline and 6.6 g. (0.08 mole) of sodium acetate in 30 ml. of methanol containing 5 ml. of water. An orange product separates. The mixture is poured into water. The orange solid is filtered, washed with water and air-dried. The product is recrystallized from ethyl acetate-tetrahydrofuran to give a total (first and second crops) of 2.86 g. of dye, m.p. 214–215° C.

e. 4-(4-dimethylaminophenylazo)benzenesulfonamido-N-dodecylaniline (5) — The lauranilide (4) (6.20 g., 0.0108 (mole) is dissolved in 250 ml. of tetrahydrofuran solvent previously dried over Linde 4A molecular sieves. To the stirred solution is added as rapidly as possible 2.05 g. (0.054 mole) of lithium aluminum hydride. The mixture is stirred at room temperature for three-fourths of an hour. Hydrated sodium sulfate is added to destroy unused hydride, followed by 0.7 ml. of acetic acid. Inorganic salts are filtered off and washed well with fresh tetrahydrofuran. The filtrate is concentrated to dryness on a rotary evaporator and the residue is recrystallized from 200 ml. of 50-50 methanol-tetrahydrofuran to give 4.6 g. of orange plates; m.p. 199.5°–200° C.

EXAMPLE 35

A single-layer supported gelatinous silver halide (cubic bromide) emulsion coating is prepared which contains per square foot of coating 60 mg. of Compound No. VIII, 0.6 ml. of diethyl lauramide, 400 mg. of gelatin and 180 mg. of silver. A sample of the photosensitive element is exposed to a graduated-density multicolor test object. A processing composition comprising Phenidone developing agent (0.25 g/l), NaOH (1 normal) and hydroxyethylcellulose (30 g/l) is employed in a pod and is spread between the exposed surface of the photosensitive element and a superposed dye image-receiving element comprising a support coated with 700 mg./ft.$^2$ of gelatin and 150 mg./ft.$^2$ of the mordant N-n-octadecyl-tri-butylammonium bromide, by passing the transfer "sandwich" between a pair of juxtaposed pressure rollers.

After 1 minute at about 22° C., the film unit separated. A negative yellow dye image of the test object is observed on the dye image-receiving sheet.

EXAMPLE 36

Preparation of Compound No. XIV

Compound XIV is prepared according to the following procedure:

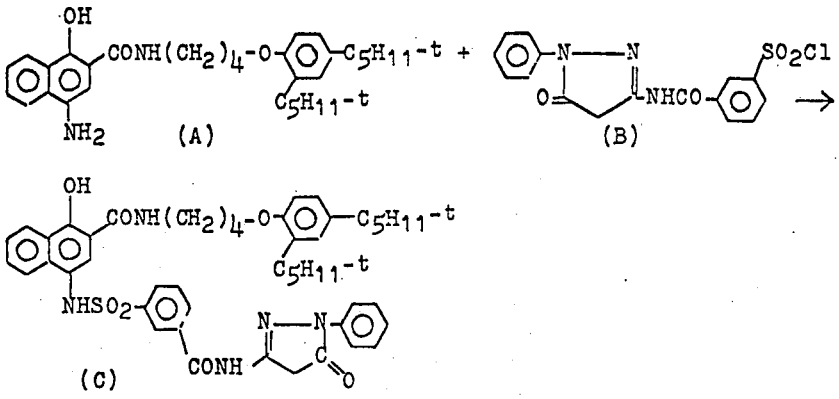

Equimolar (0.1 mol.) amounts of the amino naphthol (A) and the sulfonyl chloride (B) are allowed to react in tetrahydrofuran for 2½ hours at room temperature. After the product has separated from solution on additon of water, it is recrystallized from methanol and water, m.p. 143–146° C.

Substituted pyrazolone (C) is oxidatively coupled with 2,6-dibromo-4-aminophenol according to the following scheme:

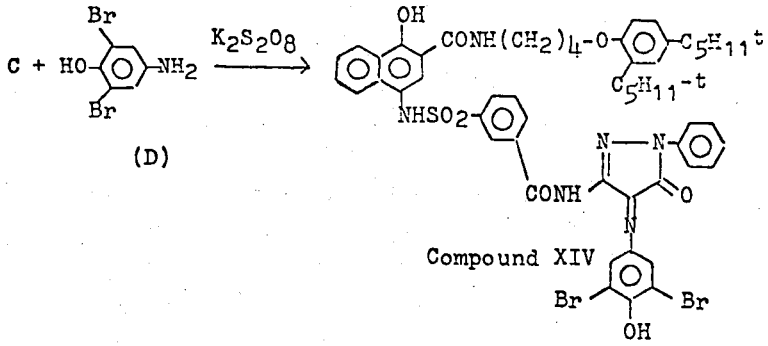

The above reaction is run by using equimolar (0.0028 mol.) quantities of (C), the aminophenol (D) and $K_2S_2O_8$ oxidant in a mixture of dilute aqueous $Na_2CO_3$ and n-butyl alcohol. The crude product is recovered from the organic phase, following washing and drying, by solvent removal. IT is then purified by column chromatography, m.p. >200° C. with decomposition.

EXAMPLE 37

A single-layer supported gelatinous silver halide emulsion coating is prepared which contains per square foot of coating 107 mg. of Compound No. XIV dispersed 1:1 in coupler solvent diethyl lauramide, 300 mg. of gelatin and 86 mg. of silver. Adjacent portions of the photosensitive element are a) unexposed and b) exposed to room light to achieve a high Dmax upon development. The element is then processed for 1 minute at 24° C. while in contact with a receiving element containing a styrene-dimethyl-benzyl ammonium-trimethylene-maleamide copolymer cationic mordant in the presence of the following viscous processing composition:

| | |
|---|---|
| NaOH | 20 g. |
| hydroxyethyl cellulose | 25 g. |
| 4-methyl-4-hydroxymethyl-1-phenyl-3-pyrazolidone | 0.75 g. |
| potassium bromide | 10 g. |
| water to 1 liter | |

After separation of the receiving element from the negative, the portion of the receiving element opposite the exposed portion of the negative is found to have a magenta color, showing that image transfer of the dye has taken place, whereas no dye is present in the portion of the receiving element opposite the unexposed portion of the negative.

Another sample of the unprocessed photosensitive element from which the silver halide has been removed by fixation is only slightly colored, thus showing that Compound No XIV "shifts" during processing.

EXAMPLE 38

Preparation of Compound No. XV

Compound XV is prepared by coupling sulfonamidophenol (E):

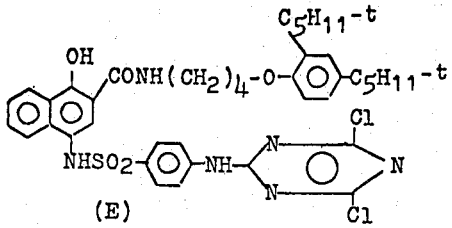

with a preformed indophenol leuco dye of the following structure:

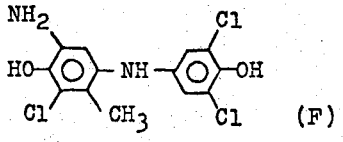

Compound (F) is made according to the following sequence of reactions:

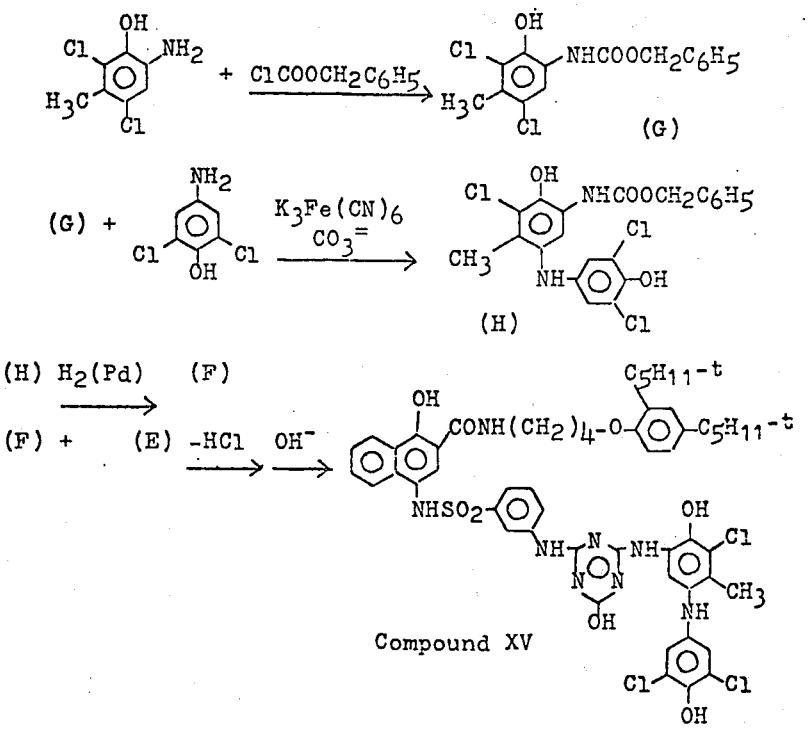

EXAMPLE 39

A single-layer supported gelatinous silver halide emulsion coating is prepared which contains per square foot of coating 107 mg. of Compound No. XV dispersed 1:1 in coupler solvent diethyl lauramide, 300 mg. of gelatin and 86 mg. of silver. A sample of the photosensitive element is exposed to a graduated-density multicolor test object and then processed as in Example 37 while in contact with a receiving element described in Example 37. After 1 minute at 24° C., the dye image-receiving element is separated from the negative. A cyan reproduction of the test object is observed on the dye image-receiving element.

Another sample of the photosensitive element from which the silver halide has been removed by fixation prior to development has a faint pink color. This indicates that the leuco Compound No. XV remains substantially unoxidized in the coating but is oxidized to form a dye after processing and becoming mordanted on the dye image-receiving element.

EXAMPLE 40

An integral multicolor photosensitive element is prepared by coating the following layers in the order recited on a transparent cellulose acetate film support:

1. image-receiving layer of copoly[styrene-N-benzyl-N,N-dimethyl-N-(3-maleimidopropyl)amonium chloride] (200 mg./ft.$^2$) and gelatin (100 mg./ft.$^2$);
2. reflecting layer of titanium dioxide (2,000 mg./ft.$^2$) and gelatin (200 mg./ft.$^2$);
3. opaque layer of carbon black (250 mg./ft.$^2$) and gelatin (312 mg./ft.$^2$);
4. Compound XLV (65 mg./ft.$^2$) and gelatin (100 mg./ft.$^2$);
5. red-sensitive, internal-image gelatin-silver chlorobromide emulsion (100 mg. gelatin/ft.$^2$ and 125 mg. silver/ft.$^2$), 2,5-di-sec-dodecylhydroquinone (25 mg./ft$^2$) and nucleating agent formyl-4-methylphenylhydrazine (1 g./mole of silver);
6. interlayer of gelatin (100 mg./ft$^2$) and 2,5-di-sec-dodecylhydroquinone (50 mg./ft.$^2$);
7. Compound XLIII (150 mg./ft.$^2$) and gelatin (175 mg./ft.$^2$);
8. green-sensitive, internal-image gelatin-silver chlorobromide emulsion (125 mg./ft.$^2$and 150 mg. silver/ft.$^2$), 2,5-di-sec-dodecylhydroquinone (50 mg./ft.$^2$) and nucleating agent formyl-4-methylphenylhydrazine (1 g./mole of silver);
9. interlayer of gelatin (100 mg./ft.$^2$) and 2,5-di-sec-dodecylhydroquinone (50 mg./ft.$^2$);
10. Compound XLI (100 mg./ft.$^2$) and gelatin (150 mg./ft.$^2$);
11. blue-sensitive, internal-image gelatin-silver chlorobromide emulsion (100 mg. gelatin/ft.$^2$ and 150 mg. silver/ft.$^2$), 2,5-di-sec-dodecylhydroquinone (50 mg./ft.$^2$) and nucleating agent formyl-4-methylphenylhydrazine (1 g./mole of silver); and
12. overcoat of gelatin (82.5 mg./ft.$^2$).

The above silver halide emulsions are direct-positive emulsions having high sensitivity and low surface sensitivity of the type described in U.S. Pat. No. 2,592,250.

The above-prepared photosensitive element is then exposed to a graduated-density multicolor test object. The following processing composition is employed in a pod and is spread between the photosensitive element and an opaque cellulose acetate sheet by passing the transfer "sandwich" between a pair of juxtaposed pressure rollers:

| | |
|---|---|
| sodium hydroxide | 40 g. |
| 4-hydroxymethyl-4-methyl-1-phenyl-3-pyrazolidone | 4 g. |
| 5-methylbenzyltriazole | 0.1 g. |
| potassium iodide | 0.01 g. |
| hydroxyethyl cellulose | 25 g. |
| distilled water to | 1000 ml. |

After 4 minutes, the element is separated from the opaque sheet, subjected to a 1-minute acid rinse, fixed for 4 minutes, washed and dried. The following sensitometric results are obtained.

| Maximum Density | | | Minimum Density | | |
|---|---|---|---|---|---|
| Red | Green | Blue | Red | Green | Blue |
| 1.24 | 1.58 | 1.96 | 0.36 | 0.42 | 0.42 |

Compound No. XLI used in this example is prepared as follows: To a solution of 7.3 g. (0.015 mole) of 1-hydroxyl-4-amino-N[Δ-(2,4-di-t-amylphenoxy)butyl]-2-napthamide in 60 ml. of dry pyridine cooled to 2° C. in an ice bath and stirred in a nitrogen atmosphere are added 6.4 g. (0.016 mole) of 1-phenyl-3-methylcarbamyl-4-(p-chlorosulfonylphenylazo)-5-pyrazolone. The mixture is stirred for 2 hours at room temperature and poured into 1 liter of ice and water containing 75 ml. of hydrochloric acid. The precipitate is collected, dried and recrystallized to give 10.4 g. of compound XLI.

EXAMPLE 41

Example 40 is repeated except that, in layer 7, Compound XLII is employed instead of XLIII at the same concentration. The following sensitometric results are obtained:

| Maximum Density | | | Minimum Density | | |
|---|---|---|---|---|---|
| Red | Green | Blue | Red | Green | Blue |
| 1.20 | 1.55 | 2.02 | 0.45 | 0.40 | 0.40 |

EXAMPLE 42

Example 40 is repeated except that, in layer 7, Compound XLIV is employed at a concentration 95 mg./ft.$^2$instead of Compound XLIII. The following sensitometric results are obtained:

| Maximum Density | | | Minimum Density | | |
|---|---|---|---|---|---|
| Red | Green | Blue | Red | Green | Blue |
| 1.26 | 1.60 | 2.52 | 0.48 | 0.48 | 0.54 |

Compounds XLII, XLIII, XLIV and XLV used in Examples 40, 41 and 42 are the subject of separate inventions by our coworkers. Teh preparations of these compounds are given herein solely to provide a complete disclosure.

Preparation of Compound XLII

To a solution of 6.45 g. (0.01 mol) of 4-aminophenylsulfamoyl-3-[2,4-bis(isopentyl)phenoxybutylcarbamoyl]-4-hydroxynaphthalene in 100 ml. of pyridine (Karl Fischer grade) at 0° C., under nitrogen, are added 4.3 g. (0.01 mol) of 4-acetamido-5-hydroxy-6-(2-methoxyphenylazo)-1-naphthalene sulfonyl chloride. The mixture is stirred at <5° C. for 30 minutes and then warmed until solution is effected. Heating is discontinued and the solution is stirred for an additional 30 minutes. The solution is poured into 200 ml. of ice and 100 ml. of concentrated hydrochloric acid. The solid is collected on a filter funnel and dried to yield 10.0 g. (96%). After one recrystallization from 300 ml. of acetic acid, the yield of pure Compound XLII is 6.1 g. (59%), m.p. 234°–6° dec.

Preparation of Compound XLIII

Predistilled N,N-dimethylformamide (250 ml.) is added to a dried flask containing 22.2 g. (0.05 mol) of α-[4-hydroxy 3-(2-methoxy-5-sulfamylphenylazo)-1-naphthoxy]propionic acid, 32.5 g. (0.05 mol) of 1-hydroxy-4-m-amino benzenesulfamyl-N-[Δ-(2,4-di-t-amylphenyoxy)butyl]-2-naphthamide, and 12.3 g. (0.05 mol) of N-ethoxycarbonyl-2-ethoxy-1,2-dihydroquinoline. The reaction is protected from atmospheric moisture and stirred at room temperature for 4 hours. The reaction is cooled in an ice bath and a solution of 25 g. (0.3 mol) of sodium bicarbonate in 500 ml. of water is added in portions to precipitate an oily solid. An additional 500 ml. of water is added to complete the precipitation. The liquid is decanted from the oily solid and the solid is washed repeatedly with water until the water phase is almost colorless. Any oily solid removed in the original or subsequent decantations is recovered by filtration and thorough washing with water. The oily product is mechanically stirred in 250 ml. of water for 1½ hours to give a crystalline material which if further ground up under water using a mortar and pestle. The resulting slurry is filtered, the solid is washed with water and dried to yield 52 g. (97%) of product, m.p. 120–160°C. The crude product is purified by stirring the product in 300 ml. of acetic acid at room temperature for 1½ hours. The solid is dissolved and reprecipitated. The slurry is filtered and the solid washed with 200 ml. of cold acetic acid followed by 500 ml. of water. The yield of pure Compound XLIII is 38 g. (71%), m.p. 168–171° C., λmax (Dimethylacetamide with triethylamine present) 520–545 nm.

Preparation of Compound XLIV

To a solution of 8.0 g. (.095 mol) of sodium bicarbonate and 12.2 g. (.0248 mol) of 1-amino-3-[2,4-bis-(isopentyl)phenoxybutylcarbamoyl]-4-hydroxynaphthalene in 80 ml. of dimethylsulfoxide, under nitrogen, are added 10.34 g. (.0245 mol) of N-[5-hydroxy-8-(3-fluorosulfonylphenylazo)-1-naphthyl]methanesulfonamide. The mixture is heated on a steam bath for 90 minutes and poured into 1 liter of ice water containing 25 ml. of concentrated hydrochloric acid. The solid is collected on a filter funnel and dried. After one slurry in 400 ml. of hot toluene and one slurry in 100 ml. of acetic acid, the yield of Compound XLIV is 12.0 g. (55%).

Preparation of Compound XLV

A mixture of 3.0 g. of sodium bicarbonate, 4.93 g. (8.10 mmole) of 5-(3-fluorosulfonylbenzenesulfonamido)-4-(2-methylsulfonyl-4-nitrophenylazo)-1-naphthol, and 3.97 g. (8.10 mmole) of 1-hydoxy-4-amino-N-[Δ-(2,4-di-t-amylphenoxy)butyl]-2-naphthamide in 30 g. dry dimethylsulfoxide is stirred at 80–100° C. for 60 minutes, cooled, and poured onto ice water containing sufficient hydrochloric acid to neutralize the excess sodium bicarbonate. The precipitated solid is filtered, washed and dried. The product is chromatographed on a silica gel-cellulose dry-packed column to obtain a purified sample of Compound XLIV.

The invention has been described with particular reference to certain preferred embodiments thereof, but it will be understood that variations and modifications can be effected within the spirit and scope of the invention.

We claim:

1. A photosensitive element comprising support having thereon at least one photosensitive silver halide emulsion layer, said silver halide emulsion layer having associated therewith a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during development in an alkaline processing composition at a pH in excess of 11, said compound being alkali-cleavable upon oxidation to release said color-providing moiety from said aniline or phenol moiety.

2. A photosensitive element comprising a support having thereon at least one photosensitive silver halide emulsion layer, each said silver halide emulsion layer having associated therewith a nondiffusible sulfonamido compound which is alkali-cleavable upon oxidation to release a diffusible color-providing moiety from the benzene nucleus, said compound having the formula:

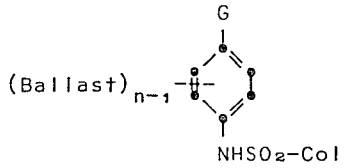

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and is 2 when G is OR or when $R_1$ is hydrogen or an alkyl group of less than 8 carbon atoms.

3. The photosensitive element of claim 2 wherein G is OH or $NH_2$.

4. The photosensitive element of claim 2 wherein said sulfonamido compound is a sulfonamidonaphthol.

5. The photosensitive element of claim 1 wherein said sulfonamido compound is:

8-acetamido-3,6-disulfo-2-{p-[(4-hydroxy-2-pen-tadecyl)-benzenesulfonamido]phenylazo}-1-naphthol monopyridinium salt;

2-{p-[(4-hydroxy-2-pentadecyl)phenylsulfamoyl]-phenylazo{-4-isopropoxynaphthol, 4-p-[4'-(N,N-dimethylamino)-phenylazo]-benzenesulfonamido}-3-pentadecylphenol;

1-hydroxy-4-[4-(1-hydroxy-4-isopropoxy-2-napthylazo)-benzenesulfonamido]-2-[Δ-(2,4-di-tert-amylphenoxy)-n-butyl]naphthamide;

1-hydroxy-4-[3-(1-phenyl-3-methylcarbamyl-4-pyrazolin-5-onylazo)-benzenesulfonamido]-2-[Δ-2,4-di-tert-amylphenoxy)-n-butyl]-napthamide;

4-[p-(4'-dimethylaminophenylazo)-benzenesulfonamido]-N-n-dodecylaniline or 1-hydroxy-4-[3-(N-[4-(3,5-dibromo-4-hydroxy-phenylimino)-l-phenyl-2-pyrazolin-5-on-3-yl]carbamyl)-benzenesulfonamido]-2-[Δ-(2,4-di-tert-amylphenoxy)-n-butyl]napthamide.

6. A photosensitive element comprising a support having thereon a red-sensitive silver halide emulsion layer having associated therewith a cyan dye image-providing material, a green-sensitive silver halide emulsion layer having associated therewith a magenta dye image-providing material, and a blue-sensitive silver halide emulsion layer having associated therewith a yellow dye image-providing material, at least one of said dye image-providing materials being a nondiffusible p-sulfonamidoaniline or p-sulfonamidophenol compound having a diffusible color-providing moiety attached through the sulfonamido group of said compound to the aniline or phenol moiety of said compound, said compound being alkali-cleavable upon oxidation to release said diffusible color-providing moiety from said aniline or phenol moiety, said aniline or phenol moiety having a ballast group of such molecular size and configuration as to render said compound substantially nondiffusible during development in an alkaline processing composition at a pH in excess of 11.

7. The photosensitive element of claim 6 wherein said sulfonamido compound has the formula:

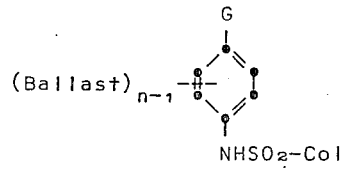

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and is 2 when G is OR or when $R_1$ is hydrogen or an alkyl group of less than 8 carbon atoms.

8. The photosensitive element of claim 7 wherein each said silver halide emulsion is a direct positive silver halide emulsion.

9. A photographic film unit comprising:

a. a photosensitive element comprising a support having thereon at least one photosensitive silver halide emulsion layer, each said silver halide emulsion layer having associated therewith a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during processing in an alkaline processing composition at a pH in excess of 11, said compound being alkali-cleavable upon oxidation to release said color-providing moiety from said aniline or phenol moiety;

b. a dye image-receiving layer; and c. an alkaline processing composition and means for discharging said composition within said film unit; said film unit containing a silver halide developing agent.

10. The film unit of claim 9 wherein said sulfonamido compound has the formula:

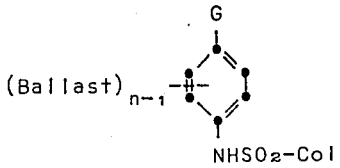

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_+$ wherein T is hydrogen or a hydrolyzable moiety and $R_1$ is hydrogen or an alkyl group of 1 to 22 carbon atoms; and d. *n* is a positive integer of 1 to 2 and is 2 when G is OR or when $R_1$ is hydrogen or an alkyl group of less than 8 carbon atoms.

11. The film unit of claim 10 wherein G is OH or $NH_2$.

12. The film unit of claim 10 wherein said sulfonamido compound is a sulfonamidonaphthol.

13. The film unit of claim 9 wherein said sulfonamido compound is:

8-acetamido-3,6-disulfo-2-{p-[(4-hydroxy-2-pentadecyl)-phenylsulfamoyl] phenylazo}-1-naphthol monopyridinium salt;

2-{p-](4-hydroxy-2-pentadecyl)-benzenesulfonamido[-phenylazo}-4-is opropoxynaphthol;

4-{-p[4'-(N,N-dimethylamino)-phenylazo]benzenesulfonamido}-3-pentadecylphenol;

1-hydroxy-4-[4-(1-hydroxy-4-isopropoxy-2-naphthylazol-benzenesulfonamido]-2-[Δ-(2,4-di-tert-amylphenoxy)-n-butyl]naphthamide;

1-hydroxy-4-[3-(1-phenyl-3-methylcarbamyl-4-pyrazolin-5-onylazol-benzenesulfonamido]-2-[Δ-(2,4-di-tert-amylphenoxy)-n-butyl[, naphthamide;

4-[p-(4'-dimethylaminophenylazo)-benzenesulfonamido[-N-n-dodecylaniline or 1-hydroxy-4-[3-(N-[4-(3,5-dibromo-4-hydroxyphenylimino)-1-phenyl-2-pyrazolin-5-on-3-yl]carbamyl)-benzenesulfonamido]-2-[Δ-(2,4-di-tert-amylphenoxy)-n-butyl]naphthamide.

14. The film unit of claim 9 wherein said dye image-receiving layer is located in said photosensitive element between said support and the lowermost photosensitive silver halide emulsion layer.

15. The film unit of claim 9 wherein said dye image-receiving layer is coated on a separate support and is adapted to be superposed on said photosensitive element after exposure thereof.

16. The film unit of claim 15 wherein said discharging means is a rupturable container and is so positioned during processing of said film unit that a compressive force applied to said container by pressure-applying members will effect a discharge of the container's contents between said dye image-receiving layer and the layer most remote from the support of said photosensitive element.

17. A photographic film unit comprising:

a. a photosensitive element comprising a support having thereon a red-sensitive silver halide emulsion layer having associated therewith a cyan dye image-providing material, a green-sensitive silver halide emulsion layer having associated therewith a magenta dye image-providing material, and a blue-sensitive silver halide emulsion layer having associated therewith a yellow dye image-providing material;

b. a dye image receiving layer; and c. a rupturable container containing an alkaline processing composition, said rupturable container being adapted to be positioned during processing of said film unit so that a compressive force applied to said container by pressure-applying members will effect a discharge of the container's contents within said film unit;

d. said film unit containing a silver halide developing agent; at least one of said dye image-providing materials being a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during processing in an alkaline processing composition at a pH in excess of 11, said compound being alkali-cleavable upon oxidation to release said color-providing moiety from said aniline or phenol moiety.

18. The film unit of claim 17 wherein said sulfonamido compound has the formula:

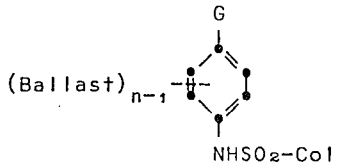

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein T is hydrogen or a hydrolyzable moiety and $R_1$ is hydorgen or an alkyl group of 1 to 22 carbon atoms; and d. *n* is a positive integer of 1 to 2 and is 2 when G is OR or when $R_1$ is hydrogen or an alkyl group of less than 8 carbon atoms.

19. The film unit of claim 18 wherein each said silver halide emulsion is a direct positive silver halide emulsion.

20. The film unit of claim 18 wherein each said sulfonamido compound is employed in combination with physical development nuclei in a layer contiguous to each said silver halide emulsion layer, said rupturable container also containing a silver halide solvent.

21. A process for producing a photographic transfer image in color from an imagewise-exposed photosensitive element comprising a support having thereon at least one photosensitive silver halide emulsion layer, said silver halide emulsion layer having associated therewith a dye image-providing material comprising a non-diffusible p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during development in an alkaline processing composition at a pH in excess of 11, said compound being alkali-cleavable upon oxidation to release said color-providing moiety from said aniline or phenol moiety; said process comprising treating said photosensitive element with an alkaline processing composition in the presence of a silver halide developing agent to effect development of each of said exposed silver halide emulsion layers, thereby oxidizing said developing agent;

i. said oxidized developing agent thereby cross-oxidizing said sulfonamido compound; and ii. said oxidized sulfonamido compound then cleaving, thus forming an imagewise distribution of diffusible color-providing moiety as a function of said imagewise exposure of each of said silver halide emulsion layers;

whereby at least a portion of said imagewise distribution of diffusible color-providing moiety diffuses to a dye image-receiving layer to provide said transfer image.

22. The process of claim 21 wherein said treatment step B) is effected by:

A. superposing over the layer outermost from the support of said photosensitive element said dye image-receiving layer coated on a support;

B. positioning a rupturable container containing an alkaline processing composition between said exposed photosensitive element and said dye image-receiving layer, said alkaline processing composition containing said developing agent; and C. rupturing said container to effect a discharge of the container's contents between said outermost layer of said exposed photosensitive element and said dye image-receiving layer.

23. The process of claim 21 wherein said sulfonamido compound has the formula:

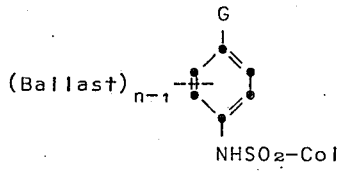

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and 2 is when G or OR or when $R_1$ is hydrogen or an alkyl group of less than 8 carbon atoms.

24. The process of claim 23 wherein G is OH or $NH_2$.

25. The process of claim 23 wherein said sulfonamido compound is a sulfonamidonaphthol.

26. The process of claim 21 wherein said sulfonamido compound is:

8-acetamido-3,6-disulfo-2- p-[(4-hydroxy-2-pentadecyl)-benzenesulfonamido]phenylazo naphthol monopyridinium salt; 2- p-[(4-hydroxy-2-pentadecyl)benzenesulfonamido]-phenylazo -4-isopropoxynaphthol;

4- p-[4'-(N,N-dimethylamino)phenylazo]benzenesulfonamido -3-pentadecylphenol;

1-hydroxy-4-[4-(1-hydroxy-4-isopropoxy-2-naphthylazo)-benzenesulfonamido]-2-[Δ-(2,4-di-tert-amylphenoxy)-n-butyl]naphthamide;

1-hydroxy-4-[3-(1-phenyl-3-methylcarbamyl-4-pyrazolin-5-onylazo)-benzenesulfonamido]-2-[Δ-(2,4-di-tert-amylphenoxy)-n-butyl]naphthamide;

4-]p-(4'-dimethylaminophenylazo)-benzenesulfonamido]-N-n-dodecylaniline or 1-hydroxy-4-[3-(N-[4-(3,5-dibromo-4-hydroxyphenylimino)-1-phenyl-2-pyrazolin-5-on-3-yl]carbamyl)-benzenesulfonamido]-2-[Δ-(2,4-di-tert-amylphenoxy)-n-butyl]naphthamide.

27. A process for producing a photographic transfer image in color comprising:

a. imagewise-exposing a photosensitive element comprising a support having thereon a red-sensitive silver halide emulsion layer having associated therewith a cyan dye image-providing material, a green-sensitive silver halide emulsion layer having associated therewith a magenta dye image-providing material, and a blue-sensitive silver halide emulsion layer having associated therewith a yellow dye image-providing material, at lease one of said dye image-providing materials being a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during processing in an alkaline processing composition at a pH in excess of 11, said compound being alkali-cleavable upon oxidation to release said color-providing moiety from said aniline or phenol moiety;

b. superposing over the layer outermost from the support of said photosensitive element a dye image-receiving layer coated on a support;

c. inserting an alkaline processing composition comprising a silver halide developing agent between said exposed photosensitive element and said dye image-receiving layer;

i. thereby effecting development of each of said exposed silver halide emulsion layers and oxidizing said silver halide developing agent;

ii. said oxidized developing agent cross-oxidizing said sulfonamido compound;

iii. said sulfonamido compound then cleaving, thus forming an imagewise distribution of diffusible color-providing moiety as a function of said imagewise exposure of each of said silver halide emulsion layers; and iv. at least a portion of said imagewise distribution of diffusible color-providing moiety diffusing to said dye image-receiving layer to provide an image; and d. separating said photosensitive element from said dye image-receiving layer coated on its said support.

28. The process of claim 27 wherein said sulfonamido compound has the formula:

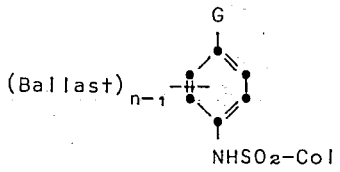

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and is 2 when G is OR or when $R_1$ is hydrogen or an alkyl group of less than 8 carbon atoms.

29. A process for producing a photographic transfer image in color comprising:

A. imagewise-exposing a photosensitive element comprising: a transparent support having thereon:

a. a dye image-receiving layer;

b. an alkaline solution-permeable, substantially opaque, light-reflective layer;

c. a red-sensitive silver halide emulsion layer having associated therewith a cyan dye image-providing material;

d. a green-sensitive silver halide emulsion layer having associated therewith a magenta dye image-providing material; and e. a blue-sensitive silver halide emulsion layer having associated therewith a yellow dye image-providing material;

at least one of said dye image-providing materials being a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during processing in an alkaline processing composition at a pH in excess of 11, said compound being alkali-cleavable upon oxidation to release said color-providing moiety from said aniline or phenol moiety; and B. developing each said exposed silver halide emulsion layer with a silver halide developing agent thereby causing said developing agent to become oxidized;

a. said oxidized developing agent thereby cross-oxidizing said sulfonamido compound;

b. said sulfonamido compound then cleaving, thus forming an imagewise distribution of diffusible color-providing moiety as a function of said imagewise exposure of each of said silver halide emulsion layers; and c. at least a portion of said imagewise distribution of diffusible color-providing moiety diffusing to said dye image-receiving layer to provide an image viewable through said transparent support.

30. The process of claim 29 wherein said sulfonamido compound has the formula:

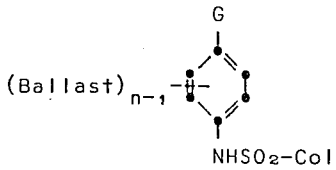

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and R1 is hydrogen or an alkyl group of 1 to 22 carbon atoms; and d. *n* is a positive integer of 1 to 2 and is 2 when G is OR or when $R_1$ is hydrogen or an alkyl group of less than 8 carbon atoms.

31. The process of claim 30 wherein each said silver halide emulsion is a direct positive silver halide emulsion which provides a positive transfer image.

32. A photographic silver halide composition comprising a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during development in an alkaline processing composition at a pH in excess of 11, said compound being alkali-cleavable upon oxidation to release said color-providing moiety from said aniline or phenol moiety.

33. The composition of claim 32 wherein said sulfonamido compound is alkali-cleavable upon oxidation to release a diffusible color-providing moiety from the benzene nucleus, said compound having the formula:

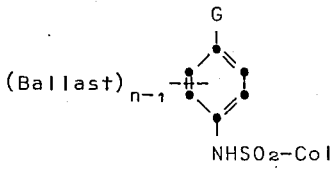

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and is 2 when G is OR or when $R_1$ is a hydrogen or an alkyl group of less than 8 carbon atoms.

34. The photosensitive element of claim 2 wherein G is OH and Col is a dye.

35. The photosensitive element of claim 2 wherein said dye precursor is a leuco dye or a shifted dye.

36. The photosensitive element of claim 7 wherein G is OH and Col is a dye.

37. The photosensitive element of claim 7 wherein said dye precursor is a leuco dye or a shifted dye.

38. The film unit of claim 10 wherein G is OH and Col is a dye.

39. The film unit of claim 10 wherein said dye precursor is a leuco dye or a shifted dye.

40. The film unit of claim 18 wherein G is OH and Col is a dye.

41. The film unit of claim 18 wherein said dye precursor is a leuco dye or a shifted dye.

42. The process of claim 23 wherein G is OH and Col is a dye.

43. The process of claim 23 wherein said dye precursor is a leuco dye or a shifted dye.

44. The film unit of claim 28 wherein G is OH and Col is a dye.

45. The process of claim 28 wherein said dye precursor is a leuco dye or a shifted dye.

46. The film unit of claim 30 wherein G is OH and Col is a dye.

47. The process of claim 30 wherein said dye precursor is a leuco dye or a shifted dye.

48. The film unit of claim 33 wherein G is OH and Col is a dye.

49. The process of claim 33 wherein said dye precursor is a leuco dye or a shifted dye.

50. A process for producing a photographic image in color from an imagewise-exposed photosensitive element comprising a support having thereon at least one photosensitive silver halide emulsion layer, said silver halide emulsion layer having associated therewith a dye image-providing material comprising a p-sulfonamidoaniline or p-sulfonamidophenol compound having a diffusible color-providing moiety attached thereto through the sulfonamido group of said compound to the aniline or phenol moiety of said compound, said aniline or phenol moiety having a ballast group of such molecular size and configuration as to render said compound substantially nondiffusible during development in an alkaline processing composition at a pH in excess of 11, said compound being alkali-cleavable upon oxidation to release said color-providing moiety from said aniline or phenol moiety, which comprises treating said photosensitive element with an alkaline processing composition in the presence of a silver halide developing agent to effect development of each of said exposed silver halide emulsion layers, thereby oxidizing said developing agent;

i. said oxidized developing agent thereby cross-oxidizing said sulfonamido compound and ii. said oxidized sulfonamido compound then cleaving, thus forming an imagewise distribution of diffusible color-providing moiety as a function of said imagewise exposure of each of said emulsion layers;

whereby at least a portion of said imagewise distribution of diffusible color-providing moiety diffuses out of said photosensitive element.

51. The process of claim 50 wherein said sulfonamido compound has the formula:

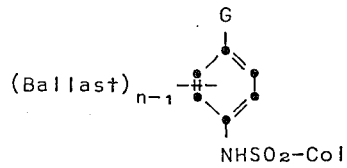

wherein:

a. Col is a dye or dye precursor moiety;

b. Ballast is an organic ballasting radical of such molecular size and configuration as to render said compound nondiffusible during development in an alkaline processing composition at a pH in excess of 11;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and is 2 when G is OR or when $R_1$ is hydrogen or an alkyl group of less than 8 carbon atoms.

52. The process of claim 51 wherein G is OH and Col is a dye.

53. The process of claim 51 wherein said dye precursor is a leuco dye or a shifted dye.

* * * * *